US011731430B2

(12) United States Patent
Pettingill et al.

(10) Patent No.: US 11,731,430 B2
(45) Date of Patent: Aug. 22, 2023

(54) DEVICE TO SUPPLY PRINTING MATERIAL

(71) Applicant: Hewlett-Packard Development Company, L.P., Spring, TX (US)

(72) Inventors: Justin Pettingill, Boise, ID (US); Gabriel McDaniel, Boise, ID (US); Sean Daniel FitzGerald, Boise, ID (US); Jeffrey H. Luke, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 81 days.

(21) Appl. No.: 17/413,691

(22) PCT Filed: Jul. 8, 2019

(86) PCT No.: PCT/US2019/040826
§ 371 (c)(1),
(2) Date: Jun. 14, 2021

(87) PCT Pub. No.: WO2021/006868
PCT Pub. Date: Jan. 14, 2021

(65) Prior Publication Data

US 2022/0348021 A1 Nov. 3, 2022

(51) Int. Cl.

| | |
|---|---|
| ***B41J 2/175*** | (2006.01) |
| ***B41J 29/38*** | (2006.01) |
| ***G03G 15/08*** | (2006.01) |
| ***G03G 21/18*** | (2006.01) |

(52) U.S. Cl.
CPC ..... *B41J 2/17509* (2013.01); *B41J 29/38* (2013.01); *G03G 15/0894* (2013.01); *G03G 21/181* (2013.01)

(58) Field of Classification Search
CPC ..... B41J 2/175; B41J 2/17509; B41J 29/02; B41J 29/38; G03G 15/0894; G03G 21/181; G03G 2215/22987
See application file for complete search history.

(56) References Cited

U.S. PATENT DOCUMENTS 5,027,984 A * 7/1991 Gakhar ..... B05C 17/0103 222/326
5,208,637 A 5/1993 Landa
5,345,297 A 9/1994 Katakabe et al.
(Continued)

FOREIGN PATENT DOCUMENTS

EP 0603910 B1 4/1997
JP H08219014 A 8/1996
(Continued)

*Primary Examiner* — Anh T Vo
(74) *Attorney, Agent, or Firm* — Foley & Lardner LLP

(57) ABSTRACT

A device is to supply printing material to a printing material container in a printing apparatus. The device includes a first container to contain printing material, a first piston movable in the first container to exert first pressure to discharge the printing material contained in the first container from the first container, a second container having an opening to the first container, and a second piston movable in the second container to exert second pressure higher than the first pressure to form a pressure gradient based on the first pressure and the second pressure through the opening. The pressure gradient is to disperse the printing material in the first container.

15 Claims, 17 Drawing Sheets

(56) References Cited

U.S. PATENT DOCUMENTS

| | | | | |
|---|---|---|---|---|
| 5,557,382 | A | 9/1996 | Tatsumi et al. | |
| 6,035,164 | A * | 3/2000 | Baek | G03G 15/104 399/238 |
| 6,257,714 | B1 | 7/2001 | Seccombe | |
| 6,829,463 | B2 | 12/2004 | Fujii et al. | |
| 6,859,634 | B2 | 2/2005 | Itoh et al. | |
| 7,650,103 | B2 | 1/2010 | Isomura | |
| 9,229,364 | B2 | 1/2016 | Murakami et al. | |

FOREIGN PATENT DOCUMENTS

| | | | |
|---|---|---|---|
| JP | 6091270 | B2 | 3/2017 |
| KR | 20160009421 | A | 1/2016 |

* cited by examiner

DEVICE TO SUPPLY PRINTING MATERIAL

BACKGROUND

A printing apparatus performs printing using printing material such as toner. A printing apparatus includes a solution that may hold, store and/or contain printing material and supply or distribute/emit print material to be used by the printing apparatus in creating visual or tactile and/or three-dimensional prints or structures. For example, a printing apparatus may include a printing material container such as a printing cartridge that contains and supplies the printing material to be used by the printing apparatus to perform printing. When the printing material contained in the printing material container or the printing cartridge is exhausted, the printing cartridge may be decoupled and removed from a body of the printing apparatus, and a new printing cartridge may be inserted or coupled to the printing apparatus. The printing cartridge may also be supplied, resupplied, reloaded, or refilled with additional printing material.

DETAILED DESCRIPTION

Figure 1:
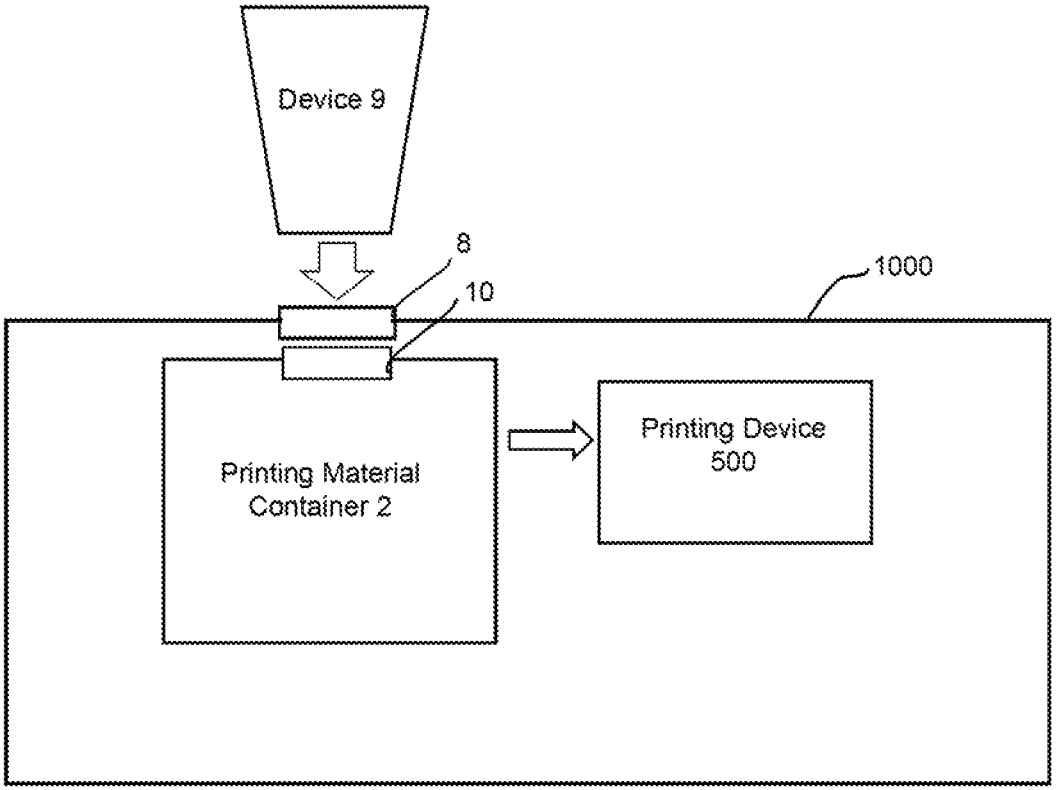
FIG. 1 is a diagram of an example of a printing apparatus.

The printing cartridge may also be refilled with new printing material by using a device to supply printing material as a printing material refill kit.

In this disclosure, when the specification states that one constituent element is "connected to" another constituent element, it includes a case in which the two constituent elements are connected to each other with another constituent element intervened therebetween as well as a case in which the two constituent elements are directly connected to each other. Further, the expression "printing apparatus" as used herein includes an apparatus that processes printing data generated at a terminal such as a computer communicating through a wired connection or wirelessly, which may be a computer for personal and/or business use, a remote server communicating data across a network or the internet, and/or a wireless mobile device such as a smartphone or tablet, to perform printing on or in a medium or in a space. Examples of the printing apparatus may include particulate-based and liquid-based printers and 2D and 3D printing apparatuses. As used herein, the term "and/or" includes any and all combinations of one or more of the associated listed items. Expressions such as "at least one of," when preceding a list of elements, modify the entire list of elements and do not modify the individual elements of the list.

Printing material is material used to print an image or an object using 2D and 3D printing technologies. Different types and forms of materials may be used as printing material. For example, printing material may be in a solid, liquid, colloidal, or gaseous form, or a combination thereof. The printing material may be non-biologic or biologic material, which may be living cells or any other biological compounds. For example, a solid or particulate form of printing material may include printing toner or metallic particulates, and a liquid form of printing material may include liquid-based ink such as ink for ink-jet printing. For example, printing material may be in a liquid form that may be curable to a different form such as a solid.

Reference will now be made in detail to examples, examples of which are illustrated in the accompanying drawings. According to an example, a device to supply printing material to a printing material container fora printing device, which may be as a printing material refill solution/kit, printing material replenishment solution/kit, and/or a printing material refill kit, which is to supply printing material to a printing material container with the printing apparatus such as a printing cartridge installable in and coupleable to a printing apparatus, may be implemented for different types of printing materials, printing cartridges, printing apparatuses and printing principles. According to an example, a device to supply printing material to a development cartridge for an electric charge-based printing is disclosed. However, according to an example, such a device as toner refill solution/kit, toner replenishment solution/kit, and/or a printing material refill kit may be implemented for different types of printing materials, printing principles and printing apparatuses. For example, a device as a printing material refill kit may be implemented for a continuous toner supply.

The printing apparatus 1000 may include some or all of the features described in this disclosure.

According to an example, referring to FIG. 1, the printing apparatus 1000 may include a printing device 500 to perform printing and printing material container to contain printing material. The printing material in the printing material container may be supplied and/or transported to the printing device 500, such that the printing device 500 may process the supplied/transported printing material to perform printing. The device 9 containing printing material may be coupled to the printing material container 2 to supply printing material in the printing material container 2. The printing material container 2 may be filled, or refilled, or replenished with printing material supplied from the device 9. The printing material container 2 may include a printing material inlet portion 10 or a printing material refilling portion 10 to receive the supplied printing material from the device 9. The device 9 may be coupled directly to the printing material inlet portion 10 or printing material refilling portion 10 to supply printing material, when the printing material container 2 is placed in the printing apparatus 1000 or out of the printing apparatus 1000. According to an example, when the device 9 is coupled to the printing material inlet portion 10 or printing material refilling portion 10, the printing material refilling portion 10 may have some or all of the features of the communication portion 8 or the refill port 8 described in this disclosure, and may function as the communication portion 8 or the refill port 8. The device 9 may be coupled indirectly to the printing material refilling portion 10. For example, the printing apparatus 1000 may include a communication portion 8, and the device may be coupled to the communication portion 8 to supply printing material to the printing material container 2 through the printing material refilling portion 10 connected to the refill port 8. Different types of printing apparatuses and printing principles may be implemented to perform printing using printing material. According to an example, printing device 500 may perform printing, which may include an electric charge-based printing, an ink-jet based printing such as ink-jet printing with a moving nozzle or a static nozzle and high-speed or high-throughput ink-jet printing, printing based on thermal bonding, printing based on chemical bonding, 2D printing, 3D printing, and a combination thereof. Different types of printing apparatuses and materials may include printing apparatuses for personal use, office use, business use, and/or industrial scale and high volume-based printing applications.

Figure 1A:
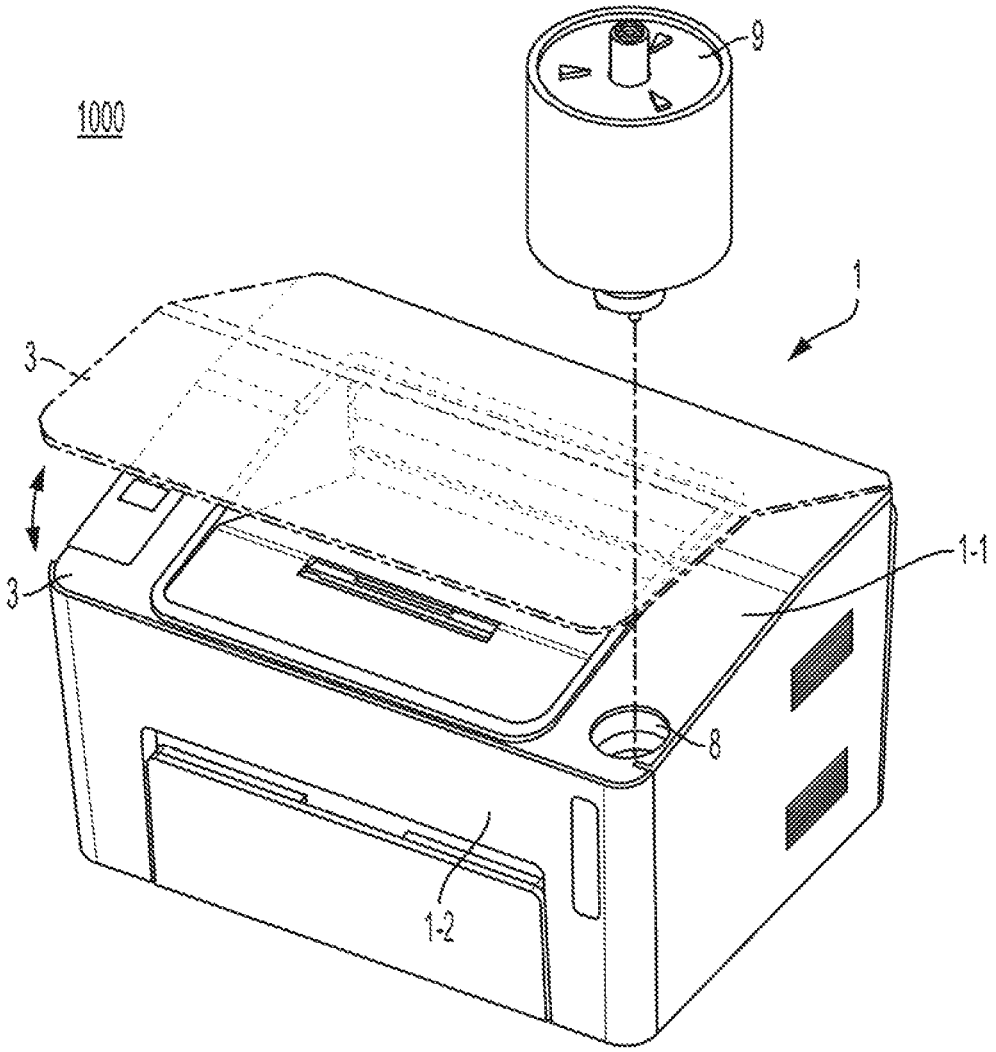
FIG. 1*a* is a perspective view of an example of the exterior of a printing apparatus.

For example, FIG. 1*a* is a perspective view of the exterior of a printing apparatus 1000 according to an example.

Figure 3:
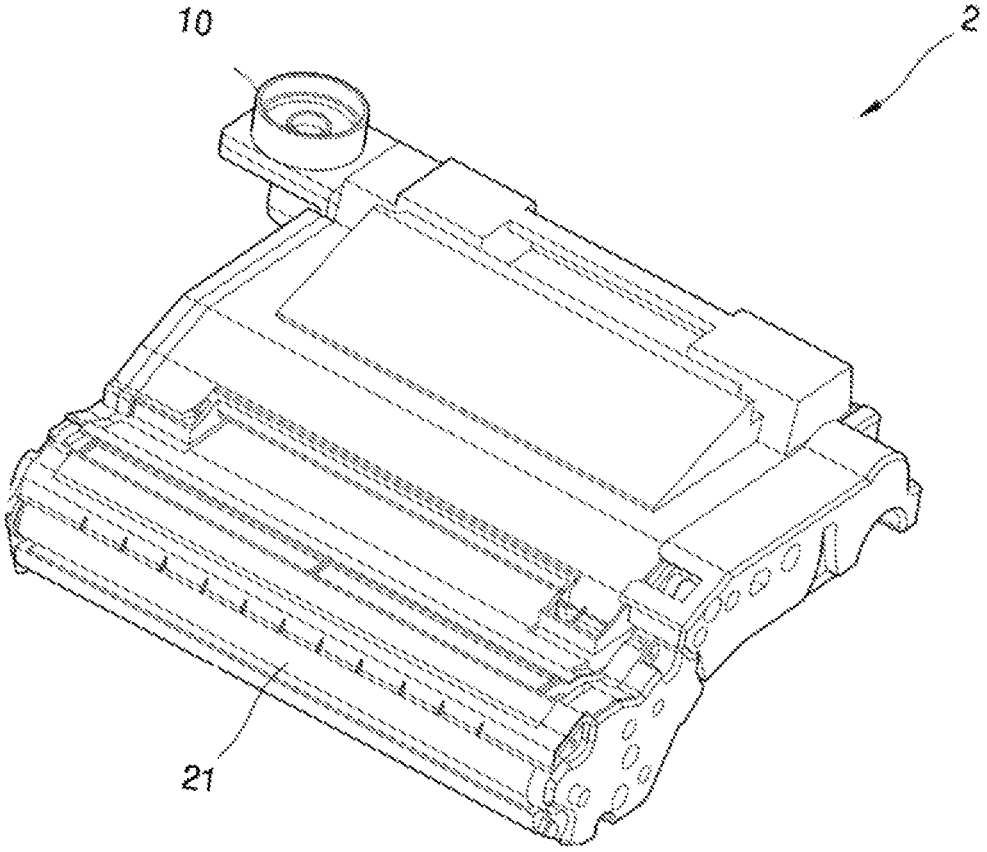
FIG. 3 is a perspective view of a printing material container as a printing cartridge, according to an example.

Referring to FIGS. 1*a*, and 3, the printing apparatus 1000 may include a body 1 and a printing material container 2 as a printing cartridge 2 that is attachable to/detachable from the body 1. A door 3 may be provided in the body 1. The door 3 opens or closes an opening of the body 1 and may cover a portion of the body 1. While the door 3 opening and closing an upper portion of the body 1 is illustrated in FIG. 1*a*, different arrangements of the door 3 may be implemented. For example, a door opening and closing a portion of the body, such as a side portion or a front portion of the body 1, may be included as needed. The printing material container 2 may be coupled to or removed from the body 1 through an opening by the door 3.

According to an example, the device 9 may be directly coupleable and/or connectable to the printing material refilling portion 10 of the printing material container 2, for example, if the printing material refilling portion 10 is exposed to the outside and accessible directly. According to an example, the printing material container 2 may be coupled to the printing apparatus 1000 and enclosed within the body 1 of the printing apparatus 1000. According to an example, the body 1 may include a communication portion 8 to communicate printing material through the body 1. The communication portion 8 may be a form of a refill port 8 through which a printing material refilling portion 10 of the printing material container 2 can be accessed from the outside the body 1 while the printing material container 2 is coupled to the body 1. According to an example, a refill port 8 may be provided at a position of the body 1, such as a top portion or a side portion of the body 1. For example, the refill port 8 may be provided at a position close to a front surface 1-2 of the body 1. When the front surface 1-2 faces the user, the user may access the refill port 8. A printing material supply or refill operation using a device 9 may be performed through the refill port 8. For example, the refill port 8 may be provided on an upper surface 1-1 of the body 1. When the printing material container 2 as a printing cartridge 2 couples to the printing apparatus 1000, the printing material refilling portion 10 may be provided to be aligned with the refill port 8. For example, the printing material refilling portion 10 may be provided under the refill port 8. According to an example, the refill port 8 and the printing material refilling portion 10 may be aligned with respect to different directions, such as vertical, horizontal or at an angled direction. The device 9 may access the printing material refilling portion 10 from above the body 1 through the refill port 8.

Figure 2A:
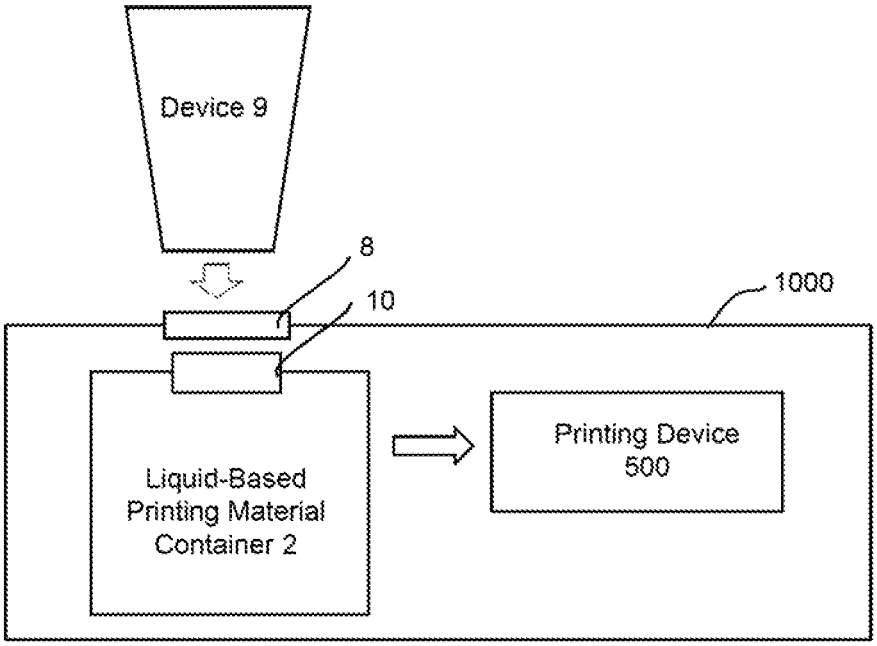
FIG. 2*a* illustrates an example of a printing apparatus.

FIG. 2*a* illustrates an example of a printing apparatus 1000 to perform printing using liquid-based printing material. Referring to FIG. 2*a*, a printing apparatus 1000 to perform printing may include a printing device 500 to selectively deposit liquid-based printing material. The printing device 500 may include a variety of different suitable liquid application systems, such as ink-jet based system, which may include a thermal printing system which involves use of heat for achieving the ejection of liquid-based printing material. According to another example, the printing device 500 may include a charge controlled printing system in which electrostatic attraction is used for ejecting liquid-based printing material. As another example, the printing device 500 may include a printing system that can use vibration pressure generated by a piezoelectric element for ejecting liquid-based printing material. For example, the printing device 500 may adopt an acoustic technique for the ejection of liquid-based printing material. In the acoustic technique, an electric signal is transformed into an acoustic beam and the compositions are irradiated by the acoustic beam so as to be ejected by radiation pressure.

According an example, a variety of different suitable liquid-based printing material application systems as the printing device 500 may include liquid-based printing material application systems employing those that are stationary during printing and span to form a printing zone, or a reciprocating printhead or nozzle, which, for diagrammatic purposes, may also be illustrated by the printing device 500.

According to an example, the printing device 500 may be implemented using one or any combination of the above mentioned examples of different suitable liquid-based printing material application systems.

Figure 2B:
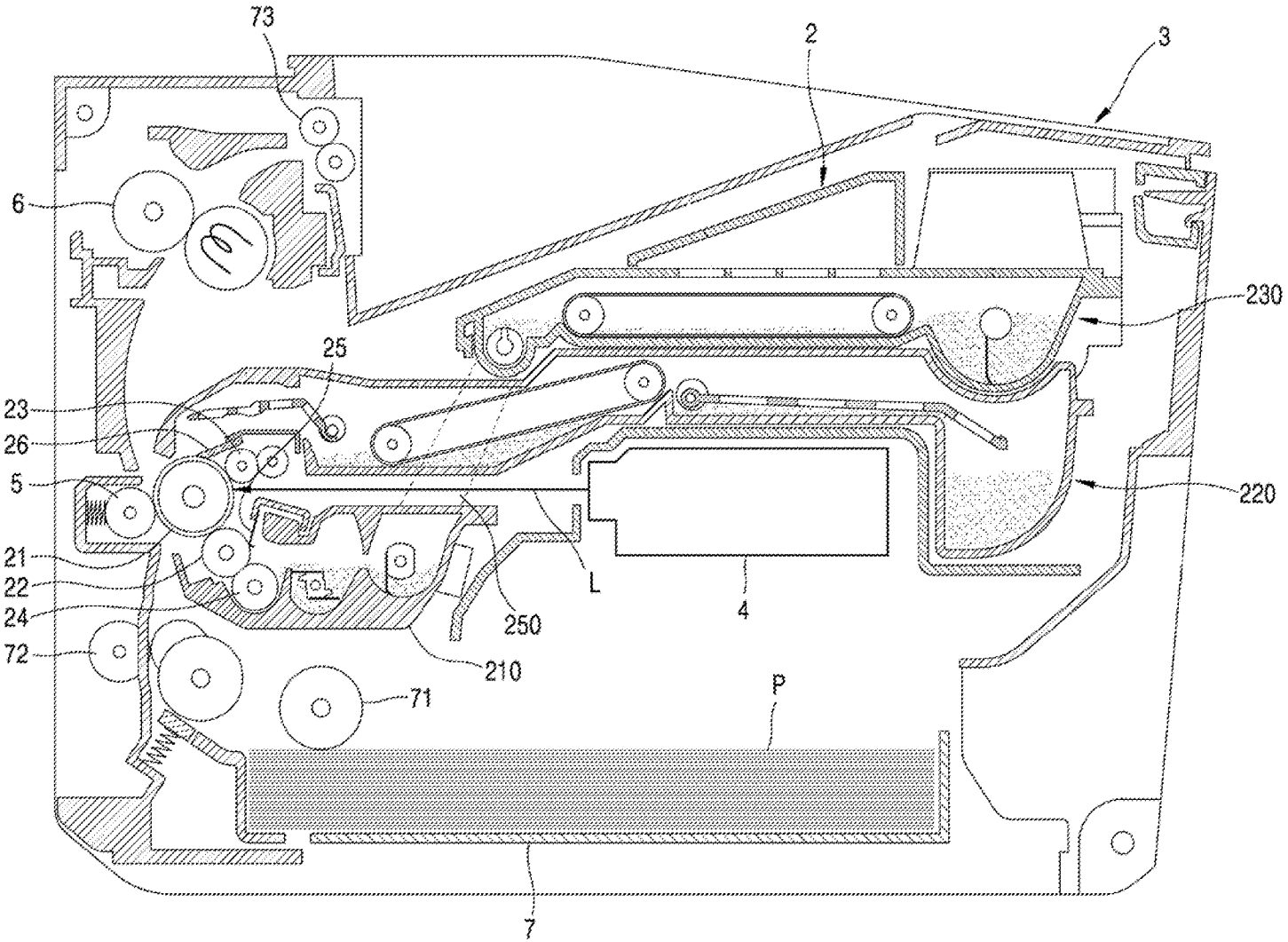
FIG. 2*b* is a structural diagram of an example of a printing apparatus.

FIG. 2*b* illustrates an example of a printing apparatus 1000 for an electric charge-based printing. Referring to FIG. 2*b*, a photosensitive drum 21 is an example of a photoconductor on which an electrostatic latent image is to be formed. For example, the photosensitive drum may include a cylindrical drum and a photoconductive photosensitive layer formed on an outer circumference of the drum. A charging roller 23 is an example of a component or material that charges a surface of the photosensitive drum 21 to have a uniform electric potential. A charge bias voltage may be applied to the charging roller 23. Instead of the charging roller 23, a corona charger (not shown) may be used. A developing roller 22 supplies printing material to an electrostatic latent image formed on a surface of the photosensitive drum 21 with beams or radiation of power or light to develop the electrostatic latent image.

According to an example, a two-component developing method may be used, in which printing material and a carrier are used as a developer. A carrier, which may be a substance that has specific magnetic or electrical properties, is commonly formed as spheres or hedrons or other geodesic shape that serve to be attracted to a magnetized substance and stack one upon another until the magnetic attraction to the magnetized substance is too weak to attract another carrier. The carrier may natively have an attractive property to print materials and serve to "carry" or collect and transfer the print material from one place to the electrostatically produced latent image where the print material is released from the carrier and temporarily attached to latent image until transferred to its intended substrate.

The developing roller 22 may be in the form of a sleeve inside of which a magnet is fixed. The sleeve may be located apart from the photosensitive drum 21 by tens to hundreds of micrometers. The carrier is attached to an outer circumference of the developing roller 22 via a magnetic force of a magnet, and printing material is attached to the carrier via an electrostatic force, which may form a form of a magnetic brush including the carrier and printing material on the outer circumference of the developing roller 22. According to a developing bias applied to the developing roller 22, only printing material is moved to the electrostatic latent image formed on the photosensitive drum 21.

In a one-component developing method in which printing material is used as a developer, the developing roller 22 may be in contact with the photosensitive drum 21, and may be located apart from the photosensitive drum 21 by a small measure, such as tens to hundreds of micrometers. In the example, a one-component contact developing method in which the developing roller 22 and the photosensitive drum 21 contacts each other to form a developing nip is used. The developing roller 22 may be in the form of an elastic layer (not shown) formed on an outer circumference of a conductive metal core (not shown). When a developing bias voltage is applied to the developing roller 22, printing material is moved via the developing nip, to the electrostatic latent image formed on a surface of the photosensitive drum 21 to be attached to the electrostatic latent image.

A supplying roller 24 attaches printing material to the developing roller 22. A supply bias voltage may be applied to the supplying roller 24 to attach printing material to the developing roller 22. A regulating member 25 regulating a printing material amount may be provided to be attached to the surface of the developing roller 22. The regulating member 25 may be, for example, a regulating blade having a front end that contacts the developing roller 22 at a certain pressure. A cleaning member 26 may be provided to remove residual printing material and foreign substances from the surface of the photosensitive drum 21 before charging. The cleaning member 26 may be, for example, a cleaning blade having a front end that contacts the surface of the photosensitive drum 21 at a certain pressure. Hereinafter, foreign substances removed from the surface of the photosensitive drum 21 will be referred to as waste printing material.

An optical projector 4 may be provided to project light modulated according to image information, onto a surface of the photosensitive drum 21 charged to a uniform electric potential. As the optical projector 4, for example, a laser or a laser unit that projects light radiated from a laser diode onto the photosensitive drum 21 by deflecting the light by using a polygon mirror, in the main scanning direction, may be used.

A transfer roller 5 is an example of a transfer unit that is located to face the photosensitive drum 21 to form a transfer nip. A transfer bias voltage used to transfer a printing material image developed on the surface of the photosensitive drum 21 to a print medium P is applied to the transfer roller 5. Instead of the transfer roller 5, a corona transfer unit may be used.

The printing material image transferred to a surface of the print medium P via the transfer roller 5 is maintained on the surface of the print medium P due to an attractive electrostatic force. A fusing or fixing unit 6 fuses the printing material image on the print medium P by applying heat and pressure to the printing material image, thereby forming a permanent print image on the print medium P.

Referring to FIGS. 2*b* and 3, the printing material container 2 as a printing cartridge 2 according to the example includes a developing portion 210 in which the photosensitive drum 21 and the developing roller 22 are mounted, a waste container 220 receiving waste printing material removed from the photosensitive drum 21, and a printing material containing portion 230 connected to the developing portion 210 and containing printing material. In order to refill printing material in the printing material containing portion 230, the printing material container 2 as a printing cartridge 2 includes a printing material refilling portion 10 connected to the printing material containing portion 230. The printing material refilling portion 10 provides an interface with respect to the printing material container 2 as a printing cartridge 2. According to an example, the printing material container 2 as a printing cartridge 2 may be an integrated type printing cartridge including the developing portion 210, the waste container 220, the printing material containing portion 230, and the printing material refilling portion 10.

A portion of an outer circumference of the photosensitive drum 21 is exposed outside a housing. A transfer nip is formed as the transfer roller 5 contacts an exposed portion of the photosensitive drum 21. At least one conveying member conveying printing material towards the developing roller 22 may be installed in the developing portion 210. The conveying member may also perform a function of charging printing material to a certain electric potential by agitating the printing material.

The waste container 220 may be located above the developing portion 210. The waste container 220 is spaced apart from the developing portion 210 in an upward direction to form a light path 250 therebetween. Waste printing material removed from the photosensitive drum 21 by using the cleaning member 26 is received in the waste container 220. The waste printing material removed from the surface of the photosensitive drum 21 is fed into the waste container 220. The shape and number of waste printing material feeding members are not limited. An appropriate number of waste printing material feeding members may be installed at appropriate locations to distribute waste printing material effectively in the waste container 220 by considering a volume or shape of the waste container 220.

The printing material containing portion 230 is connected to the printing material refilling portion 10 to receive printing material. The printing material containing portion 230 may be connected to the developing portion.

According to an example, a material supplying member may be used to supply printing material to the developing portion 210 from the printing material containing portion 230.

Referring to FIG. 2*b*, a charge bias is applied to the charging roller 23, and the photosensitive drum 21 is charged to a uniform electric potential. The optical projector 4 projects light modulated in accordance with image information, onto the photosensitive drum 21, thereby forming an electrostatic latent image on a surface of the photosensitive drum 21. The supplying roller 24 supplies printing material to a surface of the developing roller 22. The regulating member 25 may be provided to help to form a printing material layer having a uniform thickness on the surface of the developing roller 22. A developing bias voltage is applied to the developing roller 22. As the developing roller 22 is rotated, printing material conveyed to a developing nip is moved and adhered to the electrostatic latent image formed on the surface of the photosensitive drum 21 via the developing bias voltage, thereby forming a visible printing material image with the adhered printing material on the surface of the photosensitive drum 21. The print medium P may be withdrawn from a loading tray 7 by a pickup roller 71, transported and fed by a feeding roller 72 to the transfer nip where the transfer roller 5 and the photosensitive drum 21 face each other. When a transfer bias voltage is applied to the transfer roller 5, the adhered printing material in a form of the printing material image is transferred to the print medium P via an attractive electrostatic force. As the printing material image transferred to the print medium P receives heat and pressure from the fusing unit 6, the printing material image is fused to the print medium P. The print medium P may be discharged by using a discharge roller 73. The printing material that is not transferred to the print medium P but remains on the surface of the photosensitive drum 21 may be removed by using the cleaning member 26.

As described above, according to an example, referring to FIG. 2*b*, the printing material container 2 as a printing cartridge 2 supplies the printing material contained in the printing material containing portion 230 to the electrostatic latent image formed on the photosensitive drum 21 to form a visible printing material image, and is attachable to/detachable from the body 1. In addition, the printing material container 2 as a printing cartridge 2 includes the printing material refilling portion 10 used to refill printing material. The printing material refilling portion 10 may be integrated with the printing material container 2 as a printing cartridge 2 and thus may be exposed to the outside for accessibility or attachable to/detachable from the body 1 together with the printing material container 2 as a printing cartridge 2. According to the printing apparatus 1000 of the example, without removing the printing material container 2 as a printing cartridge 2 from the body 1, printing material may be refilled in the printing material container 2 as a printing cartridge 2 while the printing material container 2 as a printing cartridge 2 is mounted in the body 1. as printing material is refilled in the printing material containing portion 230 by using the printing material refilling portion 10, a replacement time of the printing material container 2 as a printing cartridge 2 may be extended, for example, until the lifetime of the photosensitive drum 21 ends, thereby reducing printing costs. In addition, printing material may be refilled while the printing material container 2 as a printing cartridge 2 is mounted in the body 1.

Referring to FIG. 3, according to an example, the printing material container 2 as a printing cartridge 2 may be an integration-type printing cartridge 2 in which the printing material refilling portion 10 is integrated, as illustrated in FIG. 3. The printing material container 2 as a printing cartridge 2 may be distributed during the product distribution stage while being mounted in the body 1. The printing material container 2 as a printing cartridge 2 may be a consumable item that is replaceable and is to be replaced when the life of the printing material container 2 as a printing cartridge 2 ends, and may be distributed separately from the body 1.

The printing material container 2 such as a printing cartridge 2 and the device 9 may be consumables removable from the printing apparatus 1000, and the printing material refilling portion 10 in the printing material container 2 such as a printing cartridge 2 may utilize the same interface as that of the printing material container 2 such as a printing cartridge 2 to connect the printing cartridge 2 and the device 9 to the body 1 of the printing apparatus 1000.

The printing apparatus 1000 may include the body 1, the printing material container 2 such as a printing cartridge 2 removable from the body 1, the printing material refilling portion 10 in the printing material container 2, and the controller 300. The printing material container 2 such as a printing cartridge 2 supplies printing material accommodated in the printing material containing portion 230 to an electrostatic latent image formed on a photoconductor to form a printing material image, the printing material container 2 such as a printing cartridge 2 being removable from the body 1. The printing material refilling portion 10 may be on the printing material container 2, and the device 9 for refilling printing material in the printing material containing portion 230 may be coupled to the printing material refilling portion 10. The controller 300 may control operations of the printing apparatus 1000 based on a connection between the printing material container 2 coupled to the body 1 and the device 9 coupled to the printing material refilling portion 10. The printing material refilling portion 10 may connect the device 9 coupled to the printing material refilling portion 10 to the body 1 through the interface between the printing material container 2 and the body 1. The printing material refilling portion 10 may be formed integrally with the printing material container 2.

According to an example, the device 9 may be coupled to the printing material refilling portion 10 through the refill port 8 from the outer surface of the body 1 of the printing apparatus 1000 when the device 9 is inserted into the refill port 8 from above the body 1, the device 9 may be coupled to the printing material refilling portion 10 as shown in FIG. 3. When the first piston 93 of the device 9 moves in the direction A1 of the first container 9 toward a portal 940 in a state in which the device 9 is coupled to the printing material refilling portion 10, printing material accommodated in the first container 91 may be discharged through a portal 940 such as a plug 940 or a port assembly 940 and supplied to the printing material containing portion 230 of the printing material container such as the printing material container 2 through the printing material refilling portion 10. The device 9 may be removed from the refill port 8 after completion of the printing material transfer.

Figure 4B:
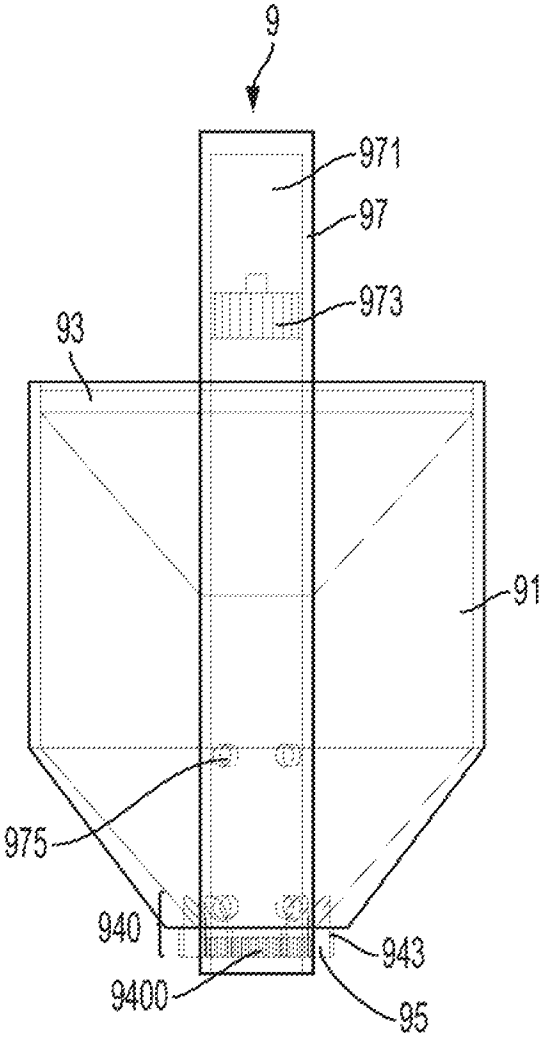
FIGS. 4*a* and 4*b* are structural diagrams of a device according to an example.
Figure 4A:
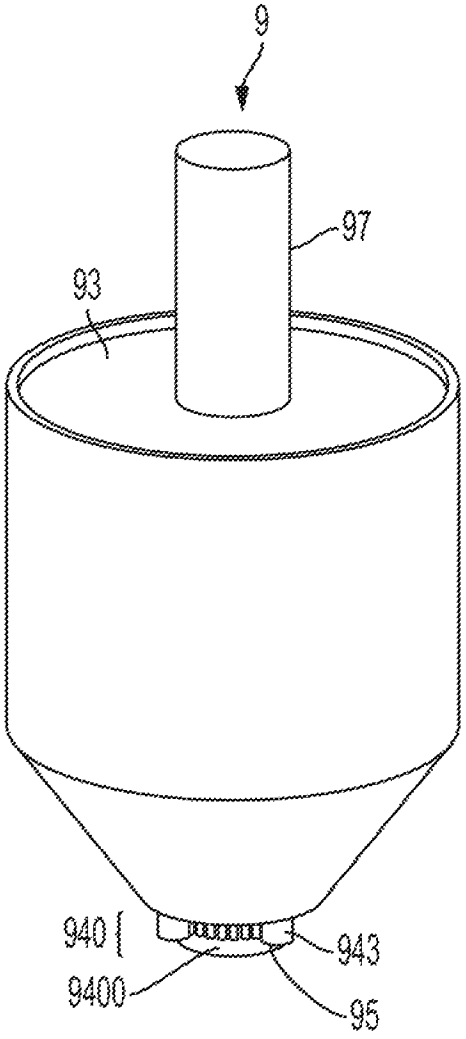

FIGS. 4*a* and 4*b* are a structural diagram of the device, which is a perspective view of an example of the device. The term "refill" is used for convenience in understanding the disclosure, and the term "refill" is not limited to a refill operation but to be construed as a printing material supply operation.

Figure 5B:
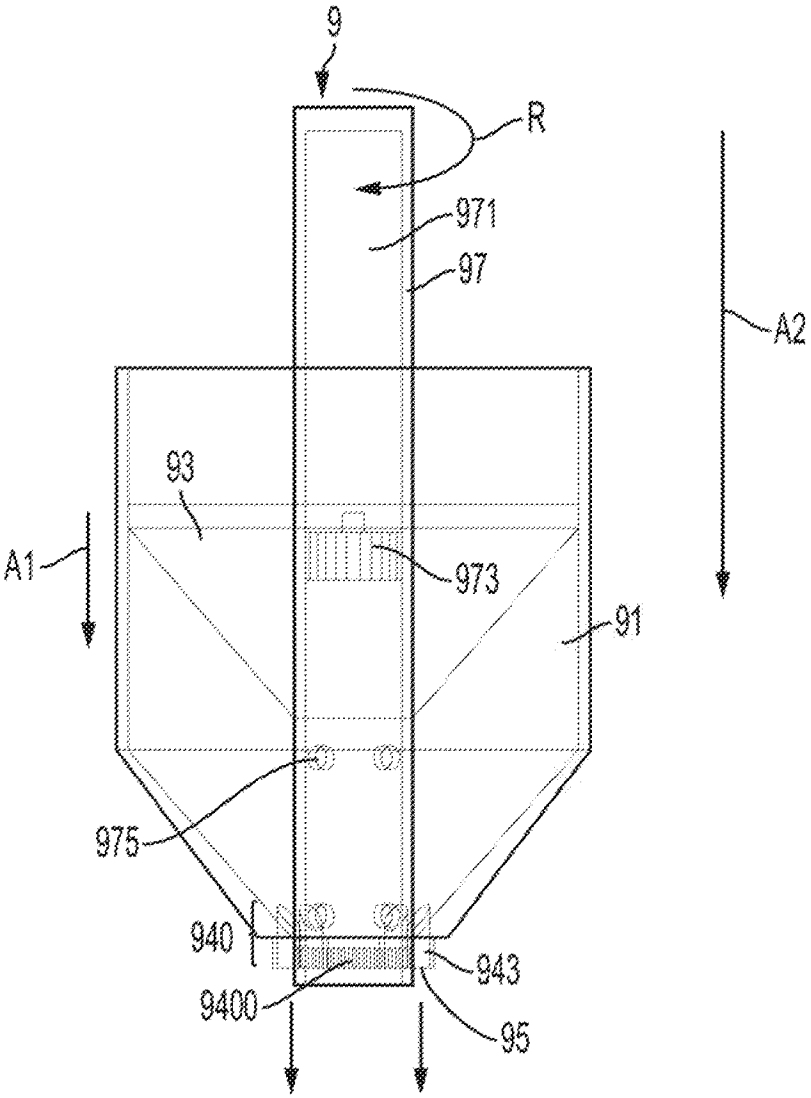
FIGS. 5*a* and 5*b* are diagrams of operation of the device according to an example.
Figure 5A:
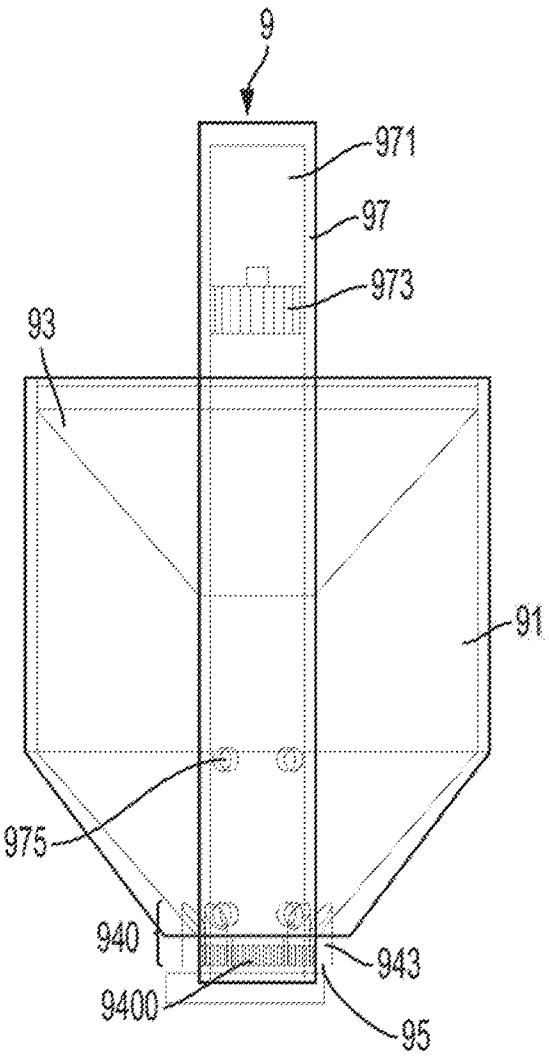

FIGS. 5*a* and 5*b* are diagrams of operation of the device according to an example.

Hereinafter, according to an example, a direction A1 and a direction A2 may be used to indicate, respectively, the direction of the movement of the first piston 93 and the movement of the second piston 973. According to an example, directions A1 and A2, respectively, may be any directions and may be different directions from each other, may be the same direction, may be the opposite directions, or may be angled directions. The directions A1 and A2, respectively, may be any directions with respect to a reference point, such as the location of the portal 940. For example, the drawings of the disclosure indicate the directions A1 and A2 to be directions toward the portal 940 and parallel to each other. According to an example, many other direction arrangements may be implemented other than the directions illustrated in the disclosure and the drawings of the disclosure.

According to an example, referring to FIG. 4*b*, the device 9 may include a first hollow body 91 as a first chamber 91, as a first container 91, to contain printing material. The device 9 may include a portal 940 that is couplable to the printing material refilling portion 10 of the printing material container 2, to discharge or transfer printing material in the first container 91 through the portal 940, and to transfer and supply printing material from the device 9 to the printing material container 2. The portal 940 may be coupled to the printing material refilling portion 10 through the refill port 8. The portal 940 may be coupled to the first container 91 or integrated with the first container 91 as a part of the first container 91. According to an example, the first container 91 may be in a form of a hopper 91. For example, the first container 91 may have a portion where its cross-sectional area with respect to the portal 940 decreases toward the portal 940, to merge a flow of printing material toward the portal 940. According to an example, the device 9 may include a first piston 93 which is movable in the first container 91. The first piston 93 may be movable to move printing material contained in the first container 91, to plunge, discharge and/or transfer the printing material through the portal 940. According to an example, the first piston 93 may move to force the printing material to be discharged through the portal 940, for example, through a discharge port 943 included in the portal 940. For example, referring to FIGS. 5*a* and 5*b*, the first piston 93 may be movable in the direction A1 toward the portal 940, to push and discharge printing material out of the first container 91 through the portal 940. The portal 940 may be provided at a tip portion of the first container 91.

According to an example, the device 9 may include a second hollow body 971 as a second chamber 971, as a second container 971, which is coupled to the first container 91 of the printing material container 2. The second container 971 may have an opening 975 to the first container 91 connecting the inner space of the first chamber 91 and the second chamber. For example, the second container 971 may have a plurality of openings 975 to the first container 91. According to an example, opening 975 may be disposed to be adjacent to the discharge port 943. According to an example, the device 9 may include a second piston 973. The second piston 973 may be movable in the second container 971 to create pressure higher than the pressure in the first container, such that a pressure gradient forms through the opening 975. The pressure gradient as a pressure differential formed through the opening may be used to move and disperse printing material contained in the first container 91. For example, referring to FIGS. 5*a* and 5*b*, the first piston 93 may be movable in a direction A2, for example, toward the portal 940, to push a medium in the second container 971, such as air, out of the second container 971 and discharge the medium into the first container 91. The discharging medium such as air may create a pressure gradient between the first container 91 and the second container 971. The discharging medium such as air may move and disperse printing material contained in the first container 91.

According to an example, referring to FIGS. 4*a*-4*b* and 5*a*-5*b*, a device 9 to supply printing material to a printing material container 2 in a printing apparatus 1000 may include a first container 91 to contain printing material, a first piston 93 movable in the first container 91 to exert first pressure to discharge printing material contained in the first container 91 from the first container 19, a second container 971 having an opening to the first container 91, and a second piston 973 movable in the second container 971 to exert second pressure higher than the first pressure to form a pressure gradient based on the first pressure and the second pressure through the opening 975, the pressure gradient to disperse printing material in the first container 91.

According to an example, referring to FIGS. 4*a*-4*b* and 5*a*-5*b*, a device 9 couplable to a printing material cartridge 2 may include a first container 91 to contain printing material, a second container 971 coupled to the first container and having an opening 975 to the first container 91, a first piston 93 movable in the first container 91 to exert first pressure to move the printing material contained in the first container 91 to be discharged from the first container 91, and a second piston 973 movable in the second container 971 to exert second pressure higher than the first pressure to form a pressure gradient based on the first pressure and the second pressure through the opening 975 to disperse the printing material in the first container 91.

According to an example, the portal 940 may be coupled to the first container 91 or integrated with the first container 91 as a part of the first container 91. According to an example, the portal 940 may include a discharge port 943 through which the printing material is transferrable from the first container 91. According to an example, referring to FIG. 9, the portal 940 may include a plurality of discharge ports 943. According to an example, when printing material is transferred out of the first container 91 and discharged through the portal 940, printing material may be discharged through the discharge port 943 included in the portal 940. According to an example, when the portal 940 couples to the refill port 8 and aligned to discharge printing material through the portal 940, the discharge port 943 may connect to the printing material inlet 902 in the refill port 8, to transfer the printing material discharged through the discharge port 943, through the printing material inlet 902, and to the printing material container 2.

According to an example, the portal 940 may include a discharge port 943 through which the printing material is transferrable from the first container 91. According to an example, referring to FIGS. 9 and 11, the portal 940 may include a plurality of discharge ports 943. According to an example, when printing material is transferred out of the first container 91 and discharged through the portal 940, printing material may be discharged through the discharge port 943 included in the portal 940. According to an example, when the portal 940 couples to the refill port 8 and aligned to discharge printing material through the portal 940, the discharge port 943 may connect to the printing material inlet 902 in the refill port 8, to transfer the printing material discharged through the discharge port 943 through the printing material inlet 902, and to the printing material container 2.

According to an example, the device 9 may include a shaft 97. A shaft 97 may be rotatably disposed and may be coupled to the first piston 93. For example, a shaft 97 may be rotatable to move the first piston 93 toward the discharge port 943, to cause the transfer of the printing material. The first piston 93 may be movable by a rotation of the shaft. For example, referring to FIGS. 4*a* and 4*b*, the device 9 may comprise a shaft 97 rotatable to move the first piston 93 toward the discharge port 943, to cause the transfer of the printing material. According to an example, the first piston 93 may move along the shaft 97 to discharge printing material contained in the first container 91 from the first container 91. According to an example, referring to FIGS. 4*a*, 4*b*, 5*a*, and 5*b*, the shaft 97 may be disposed through the first container 91 parallel to the direction A1, and the first piston 93 may move along the shaft 97 and in the direction A1. For example, the first piston 93 may be movable by a rotation of the shaft 97.

Figure 6B:
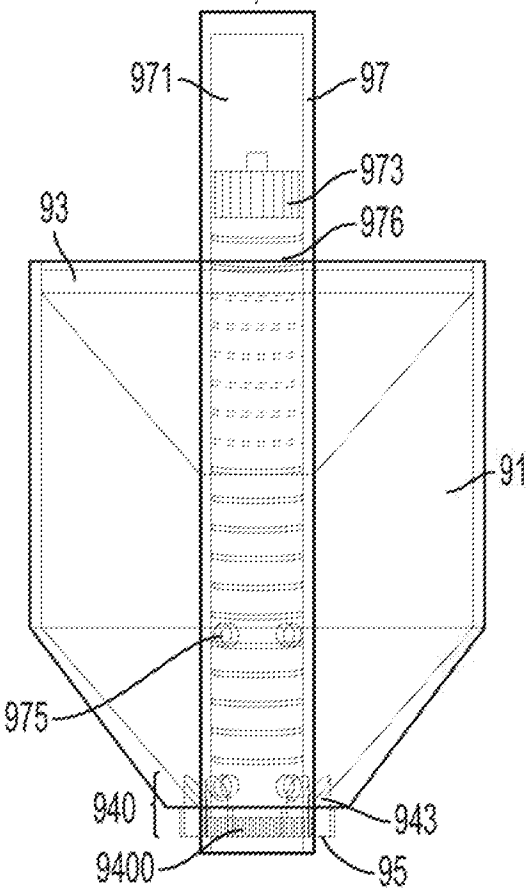
FIGS. 6*a* and 6*b* are diagrams of operation of the device having engaging portions according to an example.
Figure 6A:
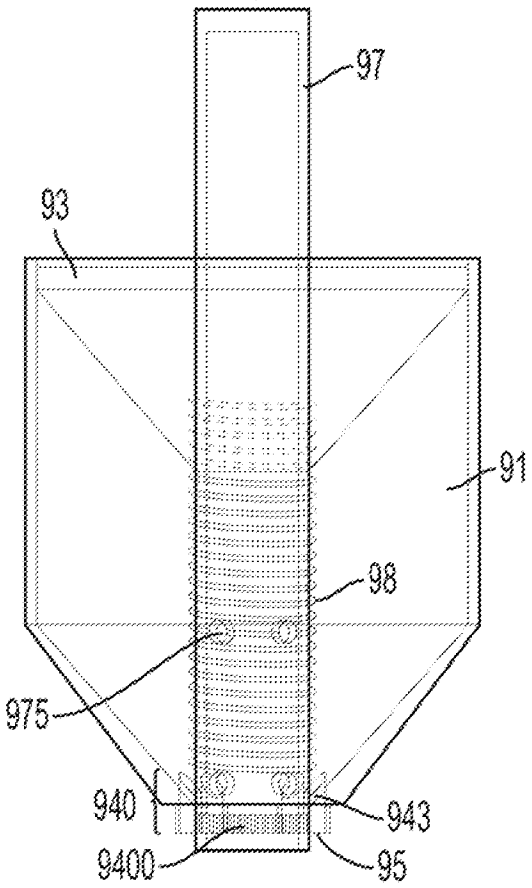

According to an example, referring to FIGS. 6*a* and 6*b*, the shaft 97 may include an engaging portion 98 to engage the first piston 93, such as a threaded portion 98, a thread 98 or a variety of possible structure for such engagement, and the first piston 93 may be to engage with the engaging portion 98 to be movable by rotating of the shaft 97 along the engaging portion 98, to cause the transfer of the printing material. For example, referring to FIGS. 6*a* and 6*b*, the shaft 97 may include a threaded portion 98, and the first piston 93 may rotate along the thread portion 98 to move along the shaft 97 in the direction A1 by the rotation R of the shaft 97. When the first piston 93 of the device 9 is moved in the direction A1 of the first container 91 toward the portal 940 in a state the device 9 is coupled to the printing material refilling portion 10, printing material accommodated in the first container 91 is discharged through the portal 940 and supplied to the printing material containing portion 230 of the printing material container 2 through the printing material refilling portion 10.

According to an example, a shaft 97 may be rotatably disposed and may be coupled to the second piston 973. For example, a shaft 97 may be rotatable to move the second piston 973 toward the portal 940, to create the pressure gradient between the first container 91 and the second container 971 through the opening 975. For example, referring to FIG. 4*b*, the device 9 may include a shaft 97 including the second container 971, or the shaft being the second container 971. According to an example, referring to FIGS. 5*a* and 5*b*, the second container 971 is a shaft 97 coupled to the first piston 93 and the second piston 973, the shaft 97 rotatable to move the first piston 93 to exert the first pressure and the second piston to exert the second pressure. According to an example, the shaft 97 may be rotatable to move the first piston 93 in the first container 91 and the second piston 973 in the second container 971 toward the portal 940, to move the printing material toward the portal 940 and create the pressure gradient between the first container 91 and the second container 971 through the opening 975. For example, the shaft 97 may be rotatable to move the first piston 93 in the first container 91 to move the printing material toward the portal 940, and to move the second piston 973 to move in the second container 971 to create the pressure gradient between the first container 91 and the second container 971 through the opening 975, to disperse the printing material being moved toward the portal 940 by the first piston 93 in the first container 91. According to an example, referring to FIGS. 4*a*, 4*b*, 5*a*, 5*b*, the shaft 97 may be disposed through the first container 91 parallel to the direction A1, and the first piston 93 and the second piston 973 may move along the shaft 97 and in the directions A1 and A2, respectively. For example, the first piston 93 and the second piston 973 may be movable by a rotation of the shaft 97.

According to an example, the shaft 97 may be rotatable to move the first piston 93 in the first container 91 and the second piston 973 in the second container 971 by different displacements or at different speeds, with respect to, for example, the discharge port 943. For example, the first piston 93 and the second piston 973 may move, respectively, at different speeds or by different displacements, with respect to the discharge port 943, by a rotation of the shaft 97. For example, the second piston 973 may move by a greater displacement or at a faster speed than the first piston 93 per a rotation of the shaft. According to an example, referring to FIGS. 5*a* and 5*b*, the second piston 973 may be to move a greater distance than the first piston 93 with respect to the shaft 97, to exert the second pressure in the second container 971 higher than the first pressure in the first container 91.

According to an example, referring to FIGS. 6*a* and 6*b*, the shaft 97 may include a threaded portion 98 to engage the first piston 93, and the first piston 93 may be to engage with the threaded portion 98 to be movable by rotating of the shaft 97 along the threaded portion 98, to cause the transfer of the printing material. For example, referring to FIGS. 6*a* and 6*b*, the shaft 97 may include a threaded portion 98, and the first piston 93 may rotate along the thread portion 98 to move along the shaft 97 in the direction A1 by the rotation R of the shaft 97. When the first piston 93 of the device 9 is moved in the direction A1 of the first container 91 in a state the device 9 is coupled to the printing material refilling portion 10, printing material accommodated in the first container 91 is discharged through the portal 940 and supplied to the printing material containing portion 230 of the printing material container 2 through the printing material refilling portion 10.

According to an example, referring to FIGS. 6*a* and 6*b*, the shaft 97 may have a first engaging portion 98 along a first side of the shaft 97, such as a first threaded portion 98, a first thread 98 or a variety of possible structure for such first engagement, and a second engaging portion 976 along a second side of the shaft, such as a second threaded portion 976, a second thread 976 or a variety of possible structure for such second engagement. For example, the first piston 93 may be movable along the first threaded portion 98. The second piston 973 may be movable along the second threaded portion 976. According to an example, the second threaded portion 976 may be coarser than the first threaded portion 98, to move the second piston 973 to a greater distance than the first piston 93 per a rotation of the shaft 97. According to an example, the first threaded portion 98 may have a finer thread than the second threaded portion 976 has. According to an example, the second threaded portion 976 may have a more coarse thread than the first threaded portion 98 has. For example, referring to FIG. 6*a*, the shaft 97 having a hollow body as the second container 971 may have a first threaded portion 98 on an external surface of the shaft 97, and, referring to FIG. 6*b*, a second threaded portion 976 along an internal surface of the shaft 97. The second threaded portion 976 may be coarser than the first threaded portion 98. The first threaded portion 98 may be finer than the second threaded portion 976. The first piston 93 may be movable along the first threaded portion 98. The second piston 973 may be movable along the second threaded portion 976. Accordingly, per a rotation of the shaft 97, the second piston 973 moving along the second threaded portion 976 that is more coarse may move along the direction A2 (parallel to the direction A1) faster and by a greater distance than the first piston 93 moving in the direction A1 parallel to the direction A2).

According to an example, because the second piston 973 in the second container 971 moves a greater distance in the direction A2 than the first piston 93 in the first container 91 moving in the direction A1, a second pressure in the second container may be created by the movement of the second piston 973 to be higher than the first pressure in the first container 91, which may be created by the movement of the first piston 93 in the first container 91.

Figure 7A:
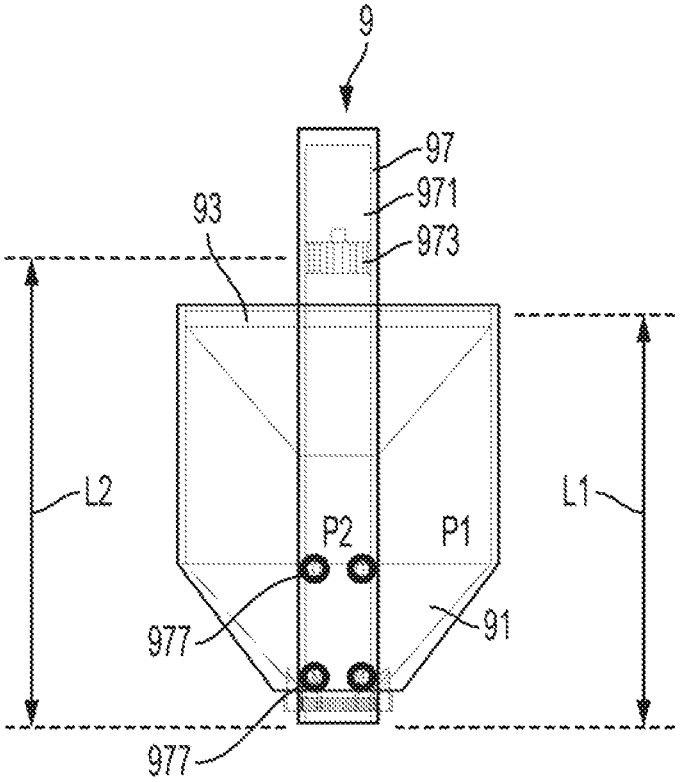
FIGS. 7*a* and 7*b* illustrate a process of creating a pressure gradient in the device according to an example.
Figure 7B:
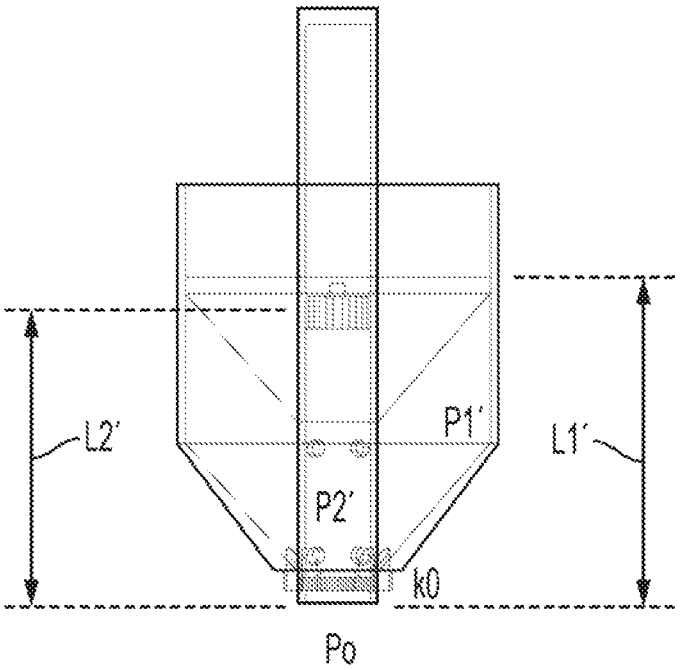

According to an example, as the first piston 93 moves in the first container 91, pressure P1 in the first container 91 may become pressure P1', which may be higher than the pressure P1. According to an example, as the second piston 973 moves in the second container 971, pressure P2 in the second container 971 may become pressure P2', which may be higher than the pressure P2. According to an example, when the second piston 973 moves along the direction A1 by a greater distance than the first piston 93 along the direction A2, the pressure P1 in the first container 91 may become the pressure P1', and the pressure P2 in the second container 971 may become the pressure P2' higher than the pressure P1' in the first container 91. For example, referring to FIG. 7*a*, when the distance between the portal 940 and the first piston 93 is L1, the pressure in the first container may be the pressure P1. When the distance between the portal 940 and the second piston 973 is L2, the pressure in the second container may be the pressure P2. The pressures P1 and P2 in this condition may be at about the same level. For example, the pressures P1 and P2 in this condition may be at about ambient pressure P0. Referring to FIG. 7*b*, when the first piston 93 moves toward the portal 940, the distance between the portal 940 and the first piston 93 may become L1', and the pressure may be increased to the pressure P1', due to the reduced volume by the movement of the first piston 93 in the first container 91. When the second piston 973 moves toward the portal 940, the distance between the portal 940 and the second piston 973 may become L2', and the pressure may be increased to the pressure P2', due to the reduced volume by the movement of the second piston 973 in the second container 971. The pressure P1' may satisfy the following mathematical relationship (1):

$$P1' = P1\frac{L1}{L1'}$$

The pressure P2' may satisfy the following mathematical relationship (2):

$$P2' = P2\frac{L2}{L2'}$$

The degree of pressure change in the first chamber 91 by the movement of the first piston 93 can be notated as ΔP1. ΔP1 may satisfy the following mathematical relationship (3):

$$P1'-P1=\Delta P1$$

The degree of pressure change in the second chamber 971 by the movement of $$P2'-P2=\Delta P2$$

the second piston 973 can be notated as ΔP2. ΔP2 may satisfy the following mathematical relationship (4):

Based on the mathematical relationships (1)-(4), the following mathematical relationship (5) may be set:

For example, when the pressures P1 and P2 in this condition may be at about the same pressure level, such as the ambient pressure P0, the mathematical $$\text{if } \frac{L1}{L1'} < \frac{L2}{L2'} \text{ then } \Delta P1 < \Delta P2$$

relationship (5) is set to be true.

According to an example, the device 9 may include a gas-permeable membrane covering the opening 975 and having channels that allows the air/gas to escape, while the size of channel is fine enough to not allow printing material, such as a particle having a size 5 micron or greater, to egress back into the second chamber.

Figure 8:
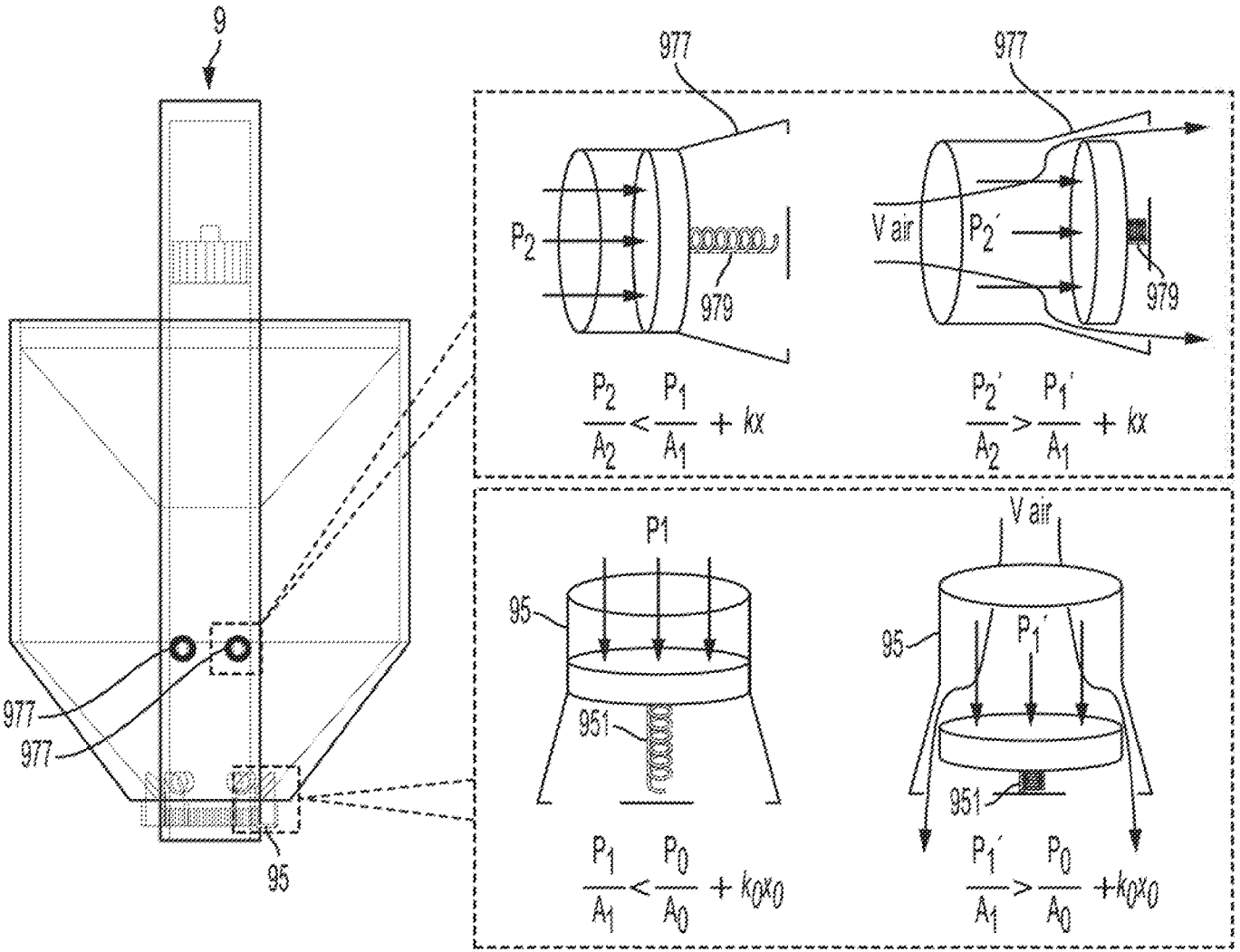
FIG. 8 is a diagram of check valves according to an example.

According to an example, the device 9 may include a first valve 977 provided to selectively open and close the opening 975. According to an example, various types of valves can be implemented to selectively open and close the opening 975, For example, the first valve 977 may be a valve openable by pressure exerted to the valve, such as a check valve. According to an example, the device 9 may include a first valve 977 to close the opening 975 and openable by the second pressure. For example, a first valve 977 may include a spring 979, and the spring force from the spring 979 may hold the first valve 977 closed, for example under pressure P1, P2 or ambient pressure P0. For example, the first valve 977 may have a check valve stiffness (k), such as an air check valve stiffness. When the pressure exerted to a second chamber side of the first valve does not overcome the pressure from the first chamber and the force of the first valve based on the check valve stiffness (k) and a valve displacement distance (x), the first valve 977 may be closed. When the pressure exerted to the second chamber side of the first valve overcomes the pressure from the first chamber and the force based on the check valve stiffness (k) and the valve displacement distance (x), the first valve 977 may be open. According to an example, referring to FIG. 4*a*, the opening 975 may include a first valve 977 provided to selectively open and close the opening 975. According to an example, the first valve 977 may be provided inside the second container 971, to selectively close and open the opening 975. For example, the first valve 977 may be provided outside of the second container 971 to close and open the portal 940 from the outside. For example, the first valve 977 may be provided at the external side of second container 971. According to an example, referring to FIG. 8, the pressures P1 and P2 may satisfy the following mathematical relationship (6):

$$\frac{P_2'}{A_2} > \frac{P_1'}{A_1} + kx$$

where, A2 is the area of the second chamber side of the first valve and A1 is the area of the first chamber side of the first valve.

When the mathematical relationship (6) is satisfied according to an example, the first valve 977 may open, allowing the first pressure P1' and the second pressure P2' to create a pressure gradient between the first container 91 and the second container 971 through the opening 975 opened by the first valve 977.

According to an example, a seal to close the discharge port 943 that is mechanically breakable, or can be broken or torn to open the discharge port 943 may be provided.

According to an example, the device 9 may include a second valve 95 provided to selectively open and close the portal 940, for example, by selectively opening and closing the discharge port 943 included in the portal 940. According to an example, the device 9 may include a second valve 95 provided to selectively open and close the portal 940, for example, by selectively blocking and unblocking the discharge port 943, to allow containment of printing material in the device 9 until the device 9 is interfaced with the printing cartridge for transferring printing material from the first container 91 to the printing material container 2. For example, referring to FIG. 4*b*, the device 9 may include a portal 940 coupleable to a refill port 8 of the printing material container 2, and to couple the first container 91 with the printing material container 2, wherein the portal 940 includes a discharge port 943 through which the printing material is dischargeable from the first container 91 and a second valve 95 to close the discharge port and openable by pressure.

According to an example, the device 9 may include a portal 940 connectable to a printing cartridge, wherein the portal may include a discharge port 943 through which the printing material is dischargeable from the first container 91, and at least one of a breakable seal to close the discharge port, or a second valve 95 to close the discharge port and openable by pressure.

According to an example, various types of valves can be implemented to selectively open and close the discharge port 943, For example, the second valve 95 may be a valve openable by pressure exerted to the second valve 95, such as a check valve. For example, a second valve 95 may include a spring 951, and the spring force from the spring 951 may hold the second valve 95 closed. For example, the second valve 95 may have a check valve stiffness (k0), such as an air check valve stiffness. When the pressure exerted to the second valve 95 does not overcome the force based on the check valve stiffness (k0) and a valve displacement distance (x0), the second valve 95 may be closed, for example, by force exerted by the spring 951. When the pressure exerted to the second valve 95 overcomes the force based on the check valve stiffness (k0) and the valve displacement distance (x0), the second valve 95 may be open, for example, by the first pressure pushing against the spring 951. For example, referring to FIG. 4*a*, the discharge port 943 may include a second valve 95 provided to selectively open and close the portal 940, by selectively opening and closing the discharge port 943. According to an example, the second valve 95 may be provided at a location with respect to the portal 940. For example, the second valve 95 may be provided inside the first container 91, to selectively close and open the discharge port 943. For example, the second valve 95 may be provided outside of the first container 91 to close and open the portal 940 and/or the discharge port 943 from the outside. For example, the second valve 95 may be provided at the external side of discharge port 943. According to an example, referring to FIGS. 7*a* and 7*b*, the pressure P1 and the ambient pressure P0 outside the device 9 may satisfy the following mathematical relationship (7):

$$\frac{P_1'}{A_1} > \frac{P_o}{A_o} + k_o x_o$$

When the mathematical relationship (7) is satisfied according to an example, the second valve 95 may open, allowing printing material in the first container 91 to be discharged through the discharge port 943 open by the second valve 95.

According to an example, the printing apparatus 1000 may include a power supply 400 to supply the power to the device 9 through the power outlet 901 to move the first piston 93 to exert the first pressure and the second piston 973 to exert the second pressure. According to an example, the first piston 93 may be movable by a manual operation or by power received from a power supply 400. For example, the shaft 97 may be manually rotated or may be rotated by power received from a power supply 400. According to an example, different forms of power may drive the device 9. For example, forms of power may include mechanical power or electrical power. According to an example, in an example of electrical power, the device 9 may include an electrical actuator, such as an electrical motor, to move the first piston 93 or to rotate the shaft 97. According to an example, a power supply 400 may be included in the device 9, the printing apparatus 1000 or printing cartridge 2. According to an example, a power supply 400 may be a separate power supply 400 directly or indirectly coupleable and/or connectable to the device 9, the printing apparatus 1000 or the printing material container 2. For example, referring to FIGS. 10*a* through 10*c*, the printing apparatus 1000 may include a power supply 400 to supply power to the device 9 through the power outlet 901 to drive the device 9 to supply printing material to the printing material container 2.

Figure 11:
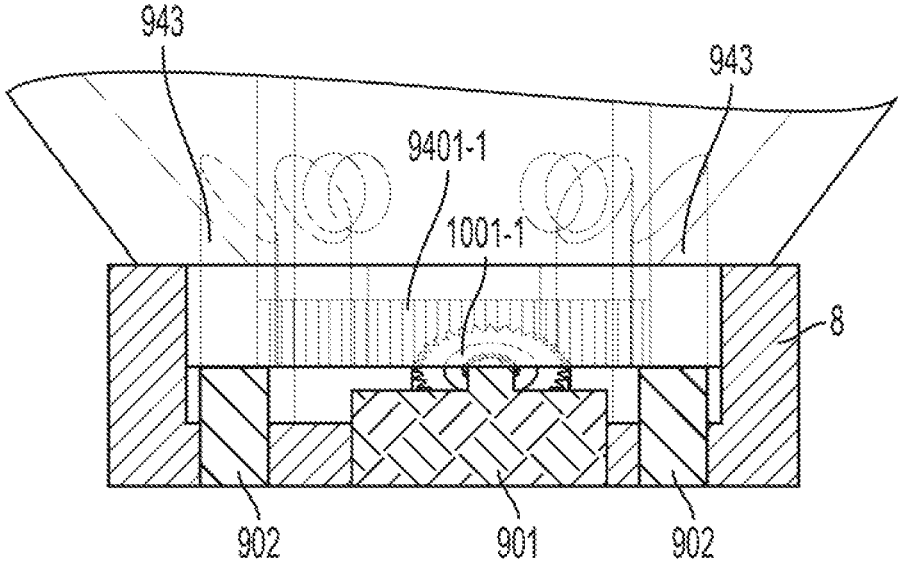
FIG. 11 is a diagram of a refill port and a portal according to an example.
Figure 12:
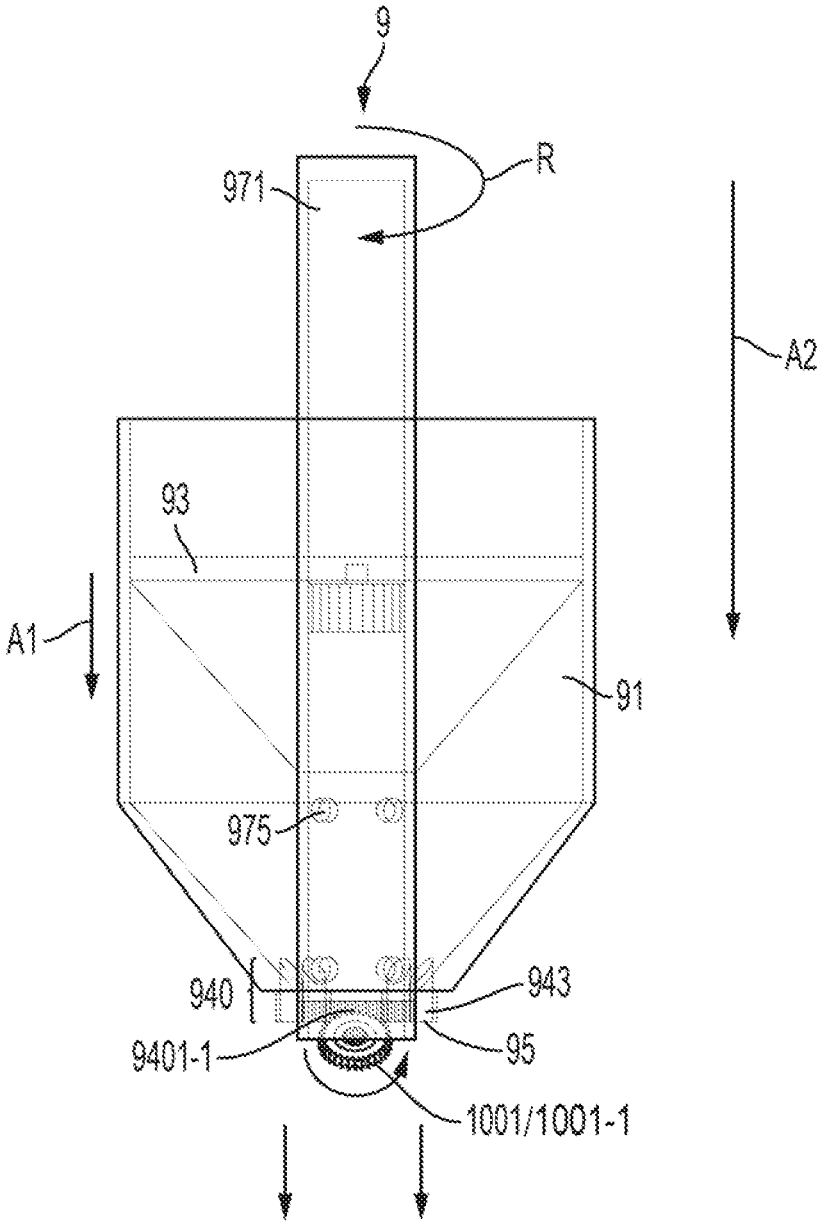
FIG. 12 is a diagram of an operation of the device by power transfer to the device according to an example.

According to an example, referring to FIGS. 1, 3, and 11, the printing apparatus 1000 to include a printing material container 2 as a printing cartridge 2 coupleable to a device 9 may include a refill port 8 through which the device 9 including printing material is couplable to the printing material container 2, wherein the device includes a first container 91 to contain printing material, a second container 971 coupled to the first container 91 and having an opening 975 to the first container 91, a first piston 93 movable in the first container 91 to exert first pressure to move the printing material contained in the first container 91 to be discharged from the first container 91, and a second piston 973 movable in the second container 971 to exert second pressure higher than the first pressure to form a pressure gradient based on the first pressure and the second pressure through the opening 975 to disperse the printing material in the first container, wherein the device 9 is to receive power through the refill port 8 to move the first piston 93 to exert the first pressure and the second piston 973 to exert the second pressure.

Figure 9:
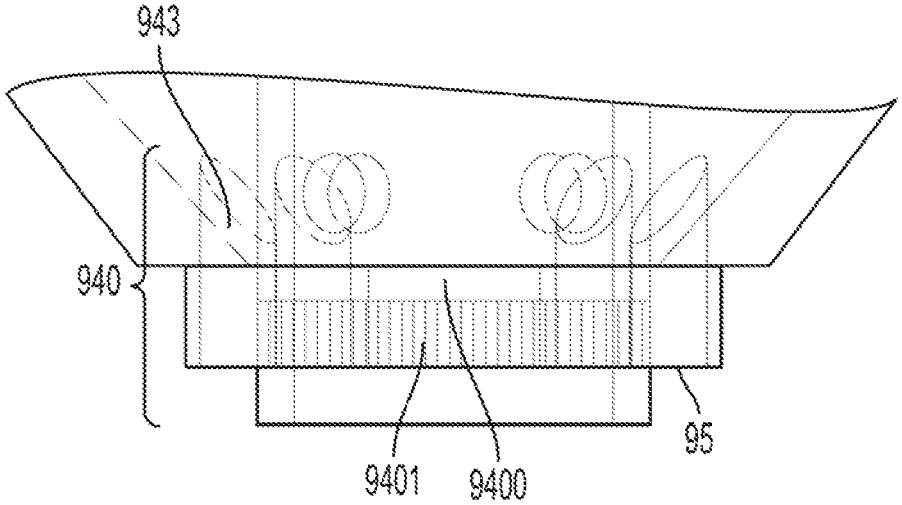
FIG. 9 is a structural diagram of the portal of the device according to an example.

FIG. 9 is a structural diagram of the portal 940 of the device 9 according to an example. The portal 940 may be coupled to the first container 91 or integrated with the first container 91 as a part of the first container 91. According to an example, the portal 940 may be disposed adjacent to a connector 9400 to receive power. According to an example, the portal 940 may include a connector 9400. For example, referring to FIGS. 4*a* and 4*b*, the device 9 may include the portal 940 couplable to the refill port 8 of the printing material container 2, and to couple the first container 91 with the printing material container 2 such as a printing cartridge 2. For example, the portal 940 may include a discharge port 943 through which the printing material is transferrable from the first container 91. According to an example, the device 9 may include a connector 9400 to receive power to move the first piston 93 to exert the first pressure and the second piston 973 to exert the second pressure. According to an example, the device 9 may include a connector 9400 to receive power to rotate the shaft 97, to move the first piston 93 to exert the first pressure and the second piston 973 to exert the second pressure For example, the portal 940 may include a connector 9400 to receive power to move the first piston 93, to cause a transfer of the printing material contained in the first container 91 to the printing material container 2 through the discharge port 943. Through the connector 9400, power may be supplied to drive the device 9 to discharge printing material. According to an example, the connector 9100 may include a first power transfer medium 9401 to receive power to drive the device 9. According to an example, the refill port 8 may include a power outlet 901, a power transference medium 901, a power take-off solution 910, or transference solution 901, through which power is supplied to drive the device 9. For example, referring to FIG. 11, the refill port 8 may include a power transference medium 901 through which the device 9 is to receive the power to drive the device 9. For example, the refill port 8 may include a power transference medium 901 through which the device 9 is to receive the power to move the first piston 93 to exert the first pressure and the second piston 973 to exert the second pressure. For example, referring to FIG. 11, the refill port 8 includes a power transference medium 901 through which the device 9 is connected to a power supply 400, to receive power to drive the device 9. According to an example, the refill port 8 may include printing material inlet 902 to be connected to the portal 940 to receive printing material.

According to an example, the power supply 400 may supply power through the refill port 8 of the printing apparatus 1000. A variety of power transferring mechanism may be implemented to transfer power. For example, the power transferring mechanism may include a Dog, Friction-clutch, Pressure-clutch, and other types of clutch to transfer power to move the first piston 93 and the second piston 973.

According to an example, the device 9 may include a connector 9400 to receive power. Referring to FIGS. 4*b* and 9, for example, the connector 9400 may be disposed to be adjacent to the portal 940. For example, the portal 940 may include the connector 9400.

Figure 10A:
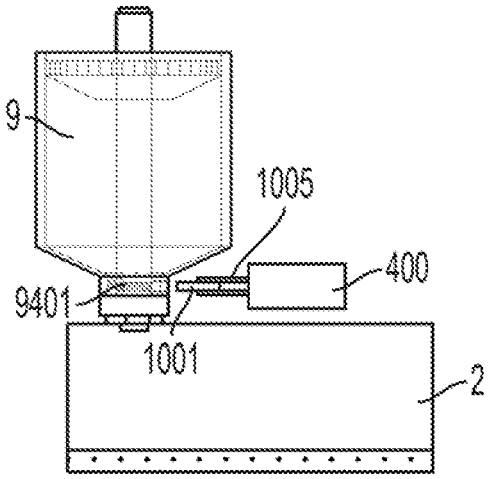
FIGS. 10*a* through 10*c* illustrate a process of a power supply to a device according to an example.
Figure 10B:
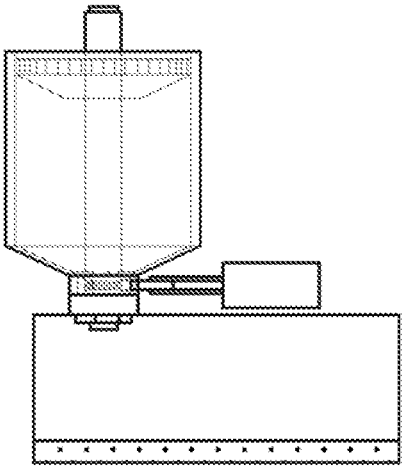
Figure 10C:
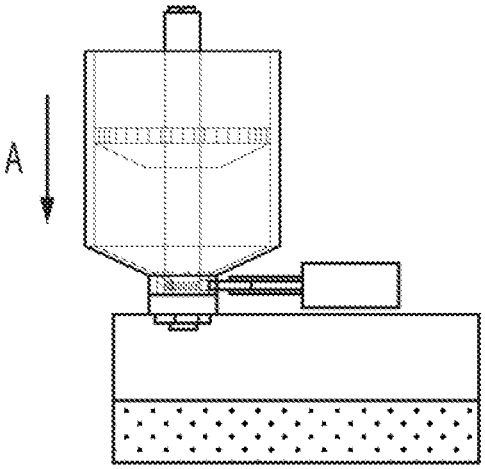
Figure 13A:
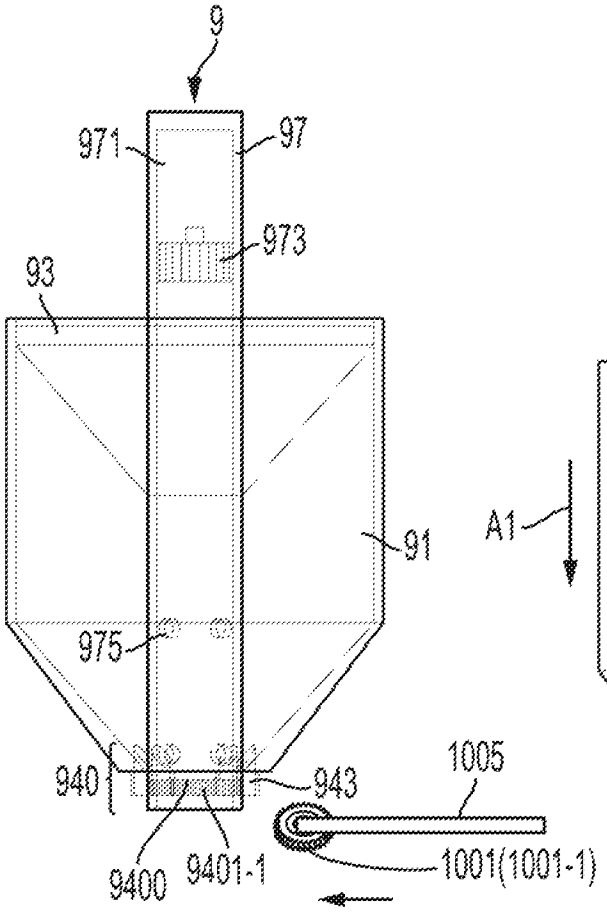
FIGS. 13*a* through 13*c* illustrate a process of engaging a first gear to a second gear according to an example.
Figure 13B:
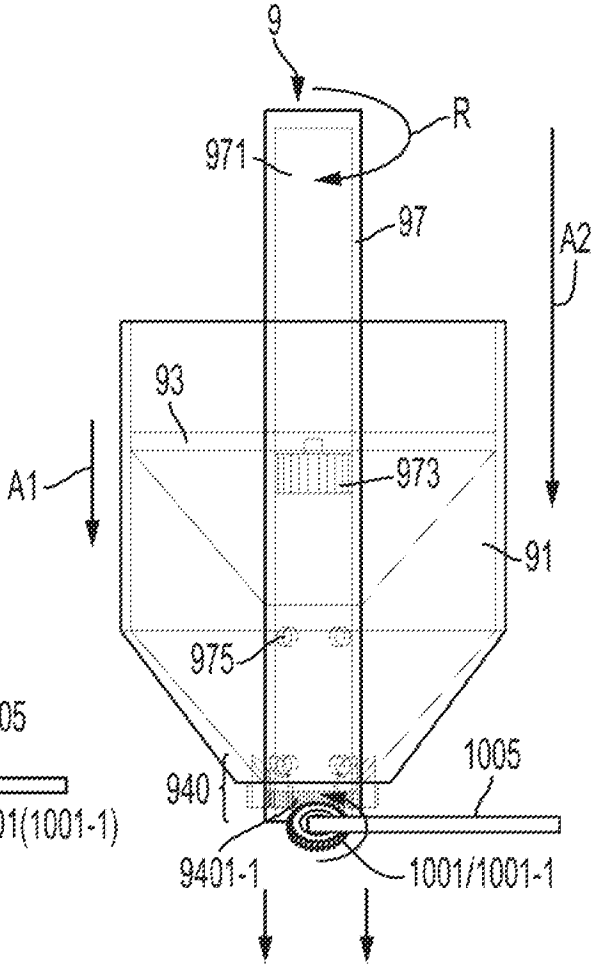
Figure 13C:
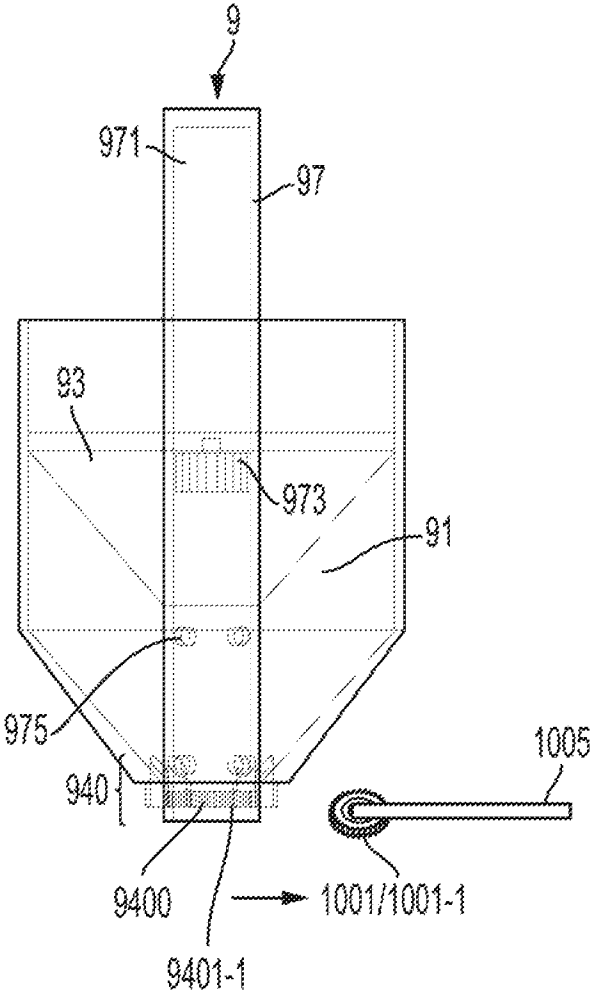

According to an example, the connector 9400 may include a first power transfer medium 9401 to receive power to drive the device 9. The refill port 8 may include a second power transfer medium 1001 to receive power from the power supply 400 and couple to the first power transfer medium 9401 to transfer power from the power supply 400. FIGS. 10*a* through 10*c* shows an example process of power supply 400. According to an example, referring to FIG. 13*a* through 13*c*, the second power transfer medium 1001 couples to the extension shaft 1005. According to an example, referring to FIG. 10*a*, the second power transfer medium 1001 may couple to the extension shaft 1005 and separated from the first power transfer medium 9401. Referring to FIG. 10*b*, the extension shaft 1005 may move the second power transfer medium 1001 to couple to the first power transfer medium 9401. Referring to FIG. 13*c*, the extension shaft 1005 may move the second power transfer medium 1001 to be separated from the first power transfer medium 9401.

According to an example, the device 9 may include a first gear 9401-1 rotatable to deliver power to move the first piston 93 to exert the first pressure and the second piston 973 to exert the second pressure, and the printing apparatus 1000 may include a second gear 1001-1 to contact the first gear 9401-1 through the power transference medium 901 as the power outlet 901 to engage with the first gear 9401-1 to supply the power. For example, referring to FIG. 11, the connector 9400 may include a gear rotatable by the power, to rotate the shaft 97 to move the first piston 93 and the second piston 973. For example, the connector 9400 may include a first gear 9401-1 as the first power transfer medium to contact a second gear 1001-1 disposed at the refill port 8 to engage with the second gear 1001-1 as the second power transfer medium, to be rotatable by the second gear 1001-1 receiving the power, to rotate the shaft 97 to move the first piston 93. According to an example, the connector 9400 may include a first gear 9401-1 as an activation gear to engage a second gear 1001-1 provided at the refill port 8. The connector 9400 may include an opening through which the first gear 9401-1 is accessible. The second gear 1001-1 may be provided at the refill port 8, and as the device 9 is coupled to the refill port and aligned to discharge and transfer printing material through the portal 940 at the refill port 8, the first gear 9401-1 may contact the second gear to engage with the second gear 1001-1, to receive power via the second gear 1001-1. According to an example, a power supply 400 may be an activation motor and supply rotational power to rotate the second gear 1001-1.

According to an example, FIGS. 10*a*-10*c*, the printing apparatus 1000 may comprise a power supply 400 to supply the power to the device through the power transference medium 901 as the power outlet 901 to drive the device to supply printing material to the printing cartridge For example, referring to FIG. 11, the device 9 may include a first gear 9401-1 rotatable to deliver power to drive the device 9 to supply printing material to the printing material container 2, and the power supply includes a second gear 1001-1 to contact the first gear 9401-1 through the power transference medium 901 as the power outlet 901 to engage with the first gear 9401-1 to supply power.

Referring to FIGS. 9 and 11, the connector 9400 may include a first gear 9401-1 as an activation gear to engage a second gear 1001-1 provided at the refill port 8. The second gear may be provided at a position at the refill port 8, and as the device 9 is coupled to the refill port 8 and aligned to discharge and transfer printing material through the portal 940 at the refill port 8, the first gear 9401-1 may engage to the second gear 1001-1, to receive power via the second gear 1001-1.

The first gear 9401-1 may be connected to the shaft 97, so as to rotate the shaft 97 with the delivered rotational power. According to an example, the first gear 9401-1 may be directly coupled to the shaft 97 or indirectly connected to the shaft 97, to drive the shaft 97 by rotating. According to an example, the first gear 9401-1 may be included in the shaft 97, for example, by being integrated on a surface of the shaft 97. As the first gear 9401-1 is engaged to the second gear and rotates, the shaft 97 may be rotated by the first gear to move the first piston 93 along the threaded portion of the shaft 97 and in the direction A1 toward the portal 940, to plunge and transfer the printing material through the portal 940.

According to an example, the second gear 1001-1 may be movable to contact the first gear 9401-1 to engage with the first gear 9401-1 and be separated from the first gear 9401-1 to disengage with the first gear 9401-1. Referring to FIGS. 11*a*, 11*b* and 11*c*, the second gear 1001-1 may be provided to be movable to a first position to contact the first gear 9401-1 to engage with the first gear 9401-1 and to a second position to disengage from the first gear 9401-1. The extension shaft may couple to the second gear 1001-1 to move the second gear 1001-1 to the first position and the second position. When the first gear 9401-1 engages the second gear 1001-1, the second gear 1001-1 may rotate the engaged first gear 9401-1 to deliver rotational power.

The printing apparatus 1000 may have an electrical structure, which may be for detecting whether the device 9 is coupled to the printing material refilling portion 10, and/or, through which information associated with the device 9 may be obtainable.

Figure 14:
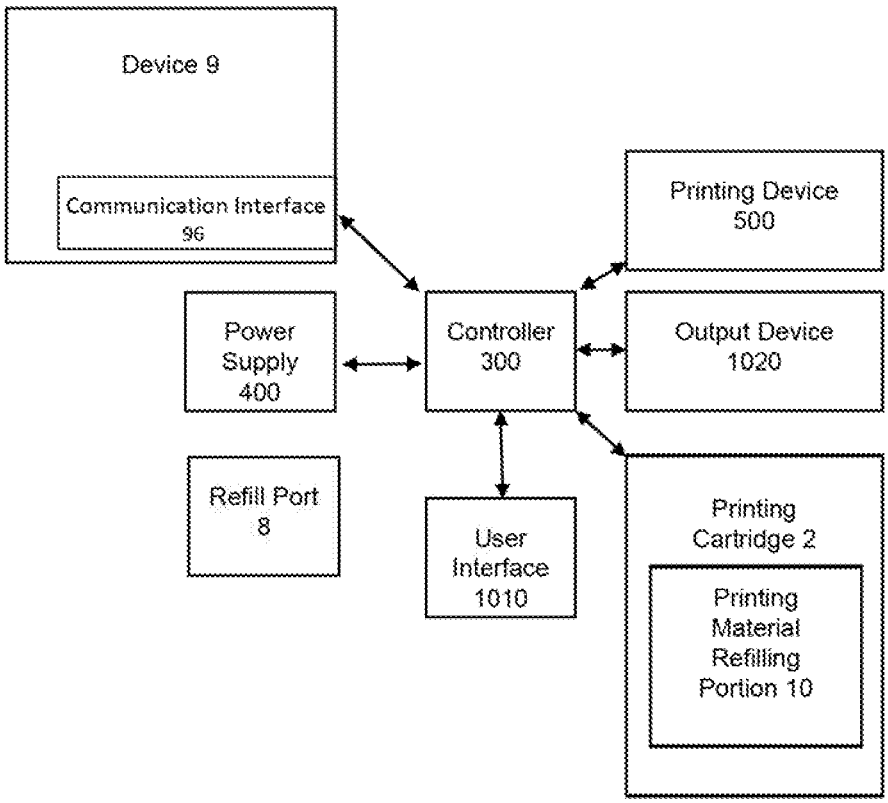
FIG. 14 is a block diagram of a printing apparatus, according to an example.

According to an example, referring to FIG. 14, the device 9 may include a communication interface 96 for communication between the device 9 and the controller 300. According to an example, the communication interface 96 may communicate with the controller wirelessly or through a wired connection. For example, the communication interface 96 may communicate with the controller 300 via a wired connection through the portal 940. When the device 9 is coupled to the printing material refilling portion 10, the communication interface 96 may be electrically connected to transfer information of the device 9. According to an example, when the device 9 is coupled to the printing material refilling portion 10 of the printing apparatus 1000, the communication interface 96 may be electrically connected to the controller via the refill port 8. According to an example, a controller 300 provided in the body 1 may obtain information to perform a control process. For example, the controller 300 may determine whether or not the device 9 is mounted based on information on the connection status of the device 9 to the refill port 8 or the printing material refilling portion 10.

According to an example, the device 9 may signal completion signal generator 92 to indicate completion of the transfer of printing material through the communication interface 96.

The printing material refilling portion 10 or the refill port 8 may be electrically connected to the device 9 coupled to the printing material refilling portion 10 and the body 1 and may transmit the information about the device 9 and the information about the printing material container 2 to the controller 300 through the interface between the printing material container 2 and the body 1. The information about the device 9 may include information for authentication of the device 9 and the information about the printing material container 2 may include information for authentication of the printing material container 2. The controller 300 may control operations of the printing apparatus 1000 based on signals or information received through a plurality of electrical contacts. The controller 300 may be a controller for a printing apparatus 1000. The controller 300 may be a controller implemented in the printing apparatus, for example, as a separate controller or integrated with the controller of the printing apparatus 1000. The controller 300 may be physically separated from the printing apparatus, such as an independent remote controller, a client device or a server in communication with the printing apparatus.

FIG. 14 is a block diagram of a printing apparatus 1000 according to an example. With reference to FIG. 10, the printing apparatus 1000 may also include a user interface 1010 which provides a user with information regarding whether the device 9 is coupled to the printing material refilling portion 10. By providing such information to a user, the user can know whether the device 9 is successfully or unsuccessfully coupled to the printing material refilling portion 10. When the device 9 is coupled to the printing material refilling portion 10 and ready or aligned to discharge and transfer printing material to the printing material container 2, power can be delivered to the device 9 to perform a plunging operation to discharge the printing material from the device 9 to the printing material container 2. When the device 9 is not fully coupled to the printing material refilling portion 10 or not aligned to discharge printing material to the printing material container 2, power may not be delivered to the device 9 to avoid an erroneous operation.

When the device 9 is coupled to the printing material refilling portion 10, the device 9 may be connected to the controller 300. The controller 300 may read information about the device 9 from the device 9. The information about the device 9 may include information for authentication of the device 9. Therefore, the controller 300 may receive the information about the device 9. The controller may also receive the information about the printing material container 2 through the interface between the printing material container 2 and the controller 300.

According to an example, the printing material refilling portion 10 may include an alignment detection sensor to detect that the device 9 coupled to the printing material refilling portion 10 enters a certain position depending on the alignment of the device 9. The printing material refilling portion 10 may transmit whether or not the mounted device 9 has reached a certain position by rotation to the controller 300, based on a result of the detection of the device 9. For example, the printing material refilling portion 10 may transmit a signal indicating that the device 9 is improperly coupled to the printing material refilling portion 10 or not aligned to discharge printing material to the printing material container 2, that the device 9 is arranged to discharge and transport printing material, and/or that the printing material refilling portion 10 is ready to receive printing material from the device 9 when the device 9 is aligned to discharge printing material.

According to an example, the controller 300 may communicate with at least one among the printing material container 2 including the printing material refilling portion 10, the refill port 8, the device 9, and the power supply 400. According to an example, a controller to meter, detect or measure an amount of printing material supplied by the device. For example, the controller may control power supply 400 to control the device 9 to supply printing material to the printing material container 2, based on information received from at least one among the printing material container 2 including the printing material refilling portion 10, the refill port 8, the device 9, and the power supply 400.

Figure 15A:
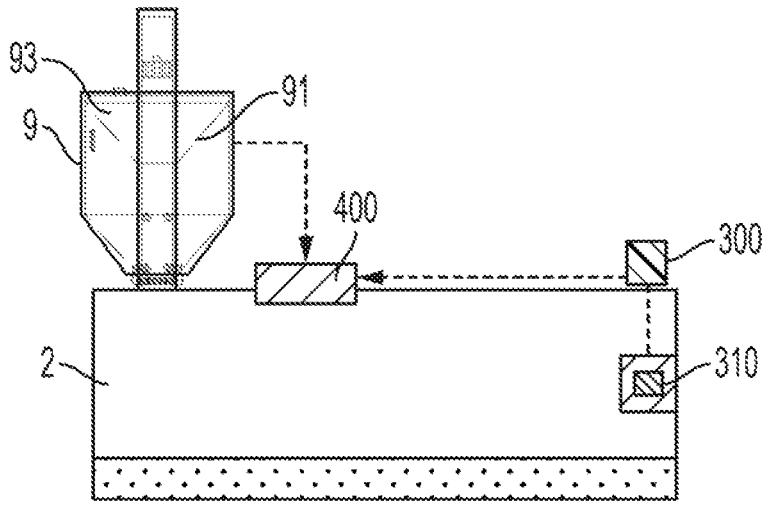
FIGS. 15*a* and 15*b* illustrate a printing material refill process controlled by a controller.
Figure 15B:
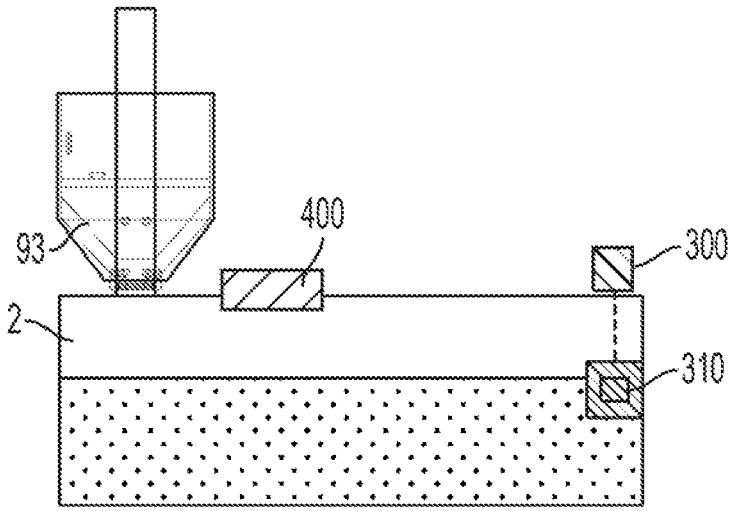

According to an example, referring to FIGS. 15*a* and 15*b*, the first piston 93 may be to move based on an amount of printing material contained in the printing material container 2 before the transfer of the printing material contained in the first container 91. According to an example, the controller 300 may control a process of printing material refill process, such as initiation and completion of the printing material refill process. For example, referring to FIGS. 14 and 15*a*-15*b*, the printing apparatus 1000 may include a controller 300 to control an amount of printing material supplied by the device 9, based on an amount of printing material in the printing material container 2. The controller 300 may be to control the amount of printing material supplied by the device 9, based on the amount of printing material in the device 9. According to an example, various types of sensors may be provided. For example, a sensor 310 to detect an amount of toner in the printing material container 2 may be provided. Different types of sensors to detect the amount of toner may be implemented, including a weight sensor and an optical sensor. According to an example, the controller may calculate an amount of printing material consumed by the printing apparatus 1000 based on a printing task of the printing apparatus 1000. For example, the controller may calculate an amount of printing material consumed by the printing apparatus 1000 based on the printing data used to perform the printing task. For example, the controller 300 may calculate how much printing material in the printing material container 2 is consumed by counting the number of pixels of an image indicated in an image data used for printing an image on a printing medium. According to an example, the device 9 may provide information to indicate an amount of toner that can be discharged and transferred to the printing material container 2. Based on such various information and detections by the sensor 310, the controller 300 may determine an amount of printing material to be discharged and transferred from the device 9 to the printing material container 2, and may control the printing apparatus according to a result of the detection. For example, the controller 300 may control to initiate and stop supply power to the device 9.

In order to remove the device 9, the device 9 may be rotated in a direction opposite to a direction in which the device 9 is rotated after being coupled to the printing material refilling portion 10.

The printing apparatus 1000 may be controlled to output information regarding the device 9 being separated from the printing material refilling portion 10. For example, a message may be presented on a screen of the user interface 1010 regarding a status of alignment or separation of the device 9, or a light indication may be provided. Further the output may be in the form of haptic feedback presented through the user interface 1010, or a sound generated by an output device 1020 such as a speaker, which may also provide a user information regarding separation of the device 9 from the printing material refilling portion 10. The user interface 1010 and output device 1020 may be combined as a single device where the user interface 1010 includes the output device 1020 or vice versa.

While various examples have been described with reference to the drawings, it will be understood that various changes in form and details may be made therein without departing from the spirit and scope as defined by the following claims.

What is claimed is:

1. A device to supply printing material to a printing material container in a printing apparatus, the device comprising:

a first container to contain printing material;

a first piston movable in the first container to exert first pressure to discharge printing material contained in the first container from the first container;

a second container having an opening to the first container; and a second piston movable in the second container to exert second pressure higher than the first pressure to form a pressure gradient based on the first pressure and the second pressure through the opening, the pressure gradient to disperse printing material in the first container.

2. The device of claim 1, wherein the second piston is to move a greater distance than the first piston to exert the second pressure higher than the first pressure.

3. The device of claim 1, further including a shaft, wherein the shaft includes the second container and coupled to the first piston and the second piston, and the shaft is rotatable to move the first piston to exert the first pressure and the second piston to exert the second pressure.

4. The device of claim 3, wherein the shaft has a first engaging portion along a first side of the shaft and a second engaging portion along a second side of the shaft, the first piston is movable along the first engaging portion, the second piston is movable along the second engaging portion, and the second engaging portion is to move the second piston a greater distance than the first piston toward a direction parallel to the shaft per a rotation of the shaft.

5. The device of claim 1, further comprising a first valve to close the opening and openable by the second pressure.

6. The device of claim 2, further comprising a connector to receive power to move the first piston to exert the first pressure and the second piston to exert the second pressure.

7. The device of claim 3, further comprising a connector to receive power to rotate the shaft, to move the first piston to exert the first pressure and the second piston to exert the second pressure.

8. The device of claim 7, wherein the connector includes a gear rotatable by the power, to rotate the shaft to move the first piston and the second piston.

9. The device of claim 1, wherein the first piston is movable based on an amount of printing material contained in a printing cartridge.

10. The device of claim 1, further comprising:

a portal connectable to a printing cartridge, the portal including a discharge port through which the printing material is dischargeable from the first container, and at least one of a breakable seal to close the discharge port, or a second valve to close the discharge port and openable by pressure.

11. The device of claim 10, wherein the opening is disposed to be adjacent to the discharge port.

12. A printing apparatus to include a printing material container to receive printing material from a device, the printing apparatus comprising:

a refill port through which the device is couplable to the printing material container, the device including:

a first container to contain printing material;

a first piston movable in the first container to exert first pressure to discharge the printing material contained in the first container from the first container;

a second container having an opening to the first container;

a second piston movable in the second container to exert second pressure higher than the first pressure to form a pressure gradient based on the first pressure and the second pressure through the opening to disperse the printing material in the first container; and a connector to receive power to move the first piston to exert the first pressure and the second piston to exert the second pressure.

13. The printing apparatus of claim 12, the refill port includes a power transference medium through which the connector is to receive the power to move the first piston to exert the first pressure and the second piston to exert the second pressure.

14. The printing apparatus of claim 13, further comprising:

a power supply to supply the power to the device through the power transference medium to move the first piston to exert the first pressure and the second piston to exert the second pressure.

15. The printing apparatus of claim 13, wherein the connector includes a first power transfer medium to deliver power to move the first piston to exert the first pressure and the second piston to exert the second pressure, and the power transference medium includes a second power transfer medium to contact the first power transfer medium to supply the power.

* * * * *